US007463834B2

(12) United States Patent
Takagi et al.

(10) Patent No.: US 7,463,834 B2
(45) Date of Patent: Dec. 9, 2008

(54) IMAGE FORMING APPARATUS AND DETACHABLY MOUNTABLE DEVELOPER CARTRIDGE

(75) Inventors: Takeyuki Takagi, Nagoya (JP); Tsutomu Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 415 days.

(21) Appl. No.: 11/360,393

(22) Filed: Feb. 24, 2006

(65) Prior Publication Data

US 2006/0193643 A1 Aug. 31, 2006

(30) Foreign Application Priority Data

Feb. 28, 2005 (JP) ..... 2005-055105

(51) Int. Cl.
*G03G 15/00* (2006.01)

(52) U.S. Cl. ..... 399/12

(58) Field of Classification Search ..... 399/12, 399/119, 111

See application file for complete search history.

(56) References Cited

U.S. PATENT DOCUMENTS

| | | | | |
|---|---|---|---|---|
| 5,479,247 | A * | 12/1995 | Watanabe et al. | |
| 5,493,366 | A * | 2/1996 | Satoh et al. | 399/111 |
| 6,009,285 | A * | 12/1999 | Barry et al. | 399/12 |
| 6,295,422 | B1 | 9/2001 | Curry et al. | |
| 6,343,883 | B1 | 2/2002 | Tada et al. | |
| 7,116,919 | B2 | 10/2006 | Ishii | |
| 2003/0137578 | A1 | 7/2003 | Yamazaki | |
| 2005/0031359 | A1 | 2/2005 | Ishii | |
| 2006/0263102 | A1 | 11/2006 | Ishii | |

FOREIGN PATENT DOCUMENTS

| | | |
|---|---|---|
| CN | 1580971 A | 2/2005 |
| EP | 1 505 459 A1 | 2/2005 |
| JP | A 63-85764 | 4/1988 |
| JP | A 6-258910 | 9/1994 |
| JP | A-07-036348 | 2/1995 |
| JP | A-11-153929 | 6/1999 |
| JP | A 2000-221781 | 8/2000 |
| JP | A 2000-221866 | 8/2000 |
| JP | A-2002-244534 | 8/2002 |
| JP | A 2003-228212 | 8/2003 |

* cited by examiner

*Primary Examiner*—Susan S Lee
(74) *Attorney, Agent, or Firm*—Oliff & Berridge, PLC

(57) ABSTRACT

A developer cartridge is configured to be detachably mounted in a main body of an image forming apparatus. A drive member is configured to be driven by the driving force and to move in a moving direction when the developer cartridge is mounted in the apparatus main body. A moving portion is provided on the drive member and is configured to move together with the drive member in the moving direction. An interfering portion is disposed downstream of a predetermined detection position with respect to the moving direction, thereby interfering with the moving portion and preventing the moving portion from passing the predetermined detection position a second time. A detecting portion detects passage of the moving portion at the predetermined detection position. An information determining portion determines information on the developer cartridge based on detection results of the detecting portion.

37 Claims, 14 Drawing Sheets

IMAGE FORMING APPARATUS AND DETACHABLY MOUNTABLE DEVELOPER CARTRIDGE

CROSS REFERENCE TO RELATED APPLICATIONS

This application claims priority from Japanese Patent Application No. 2005-055105 filed Feb. 28, 2005. The entire content of the priority application is incorporated herein by reference.

TECHNICAL FIELD

The invention relates to an image forming apparatus such as a laser printer, and a developer cartridge detachably mounted in the image forming apparatus.

BACKGROUND

In conventional laser printers, developer cartridges accommodating toner are detachably mounted therein. This type of laser printer is provided with new product detecting means for detecting whether the developer cartridge mounted in the laser printer is a new product and for determining the life of the developer cartridge from the point that the new product was detected.

For example, Japanese Patent Application Publication No. 2000-221781 proposes a developing device in which is provided a sector gear having a recessed part and a protruding part. When a new developing device is mounted in the body of an electrophotographic image forming apparatus, the protruding part formed on the sector gear is inserted into a new product side sensor, turning the new product side sensor on. After the developing device has been mounted in the body of the image forming apparatus, an idler gear is driven to rotate. When the idler gear begins to rotate, the sector gear also rotates, moving the protruding part from the new product side sensor to an old product side sensor. The protruding part is inserted into the old product side sensor, turning the old product side sensor on. At the same time, the idler gear arrives at the recessed part of the sector gear, and the sector gear stops rotating.

SUMMARY

However, in the new product detecting means described in Japanese Patent Application Publication No. 2000-221781, both a new product side sensor and an old product side sensor are essential because the protruding part is inserted either into the new product sensor for detecting a new product or the old product sensor for detecting an old product. Accordingly, this structure increases the cost and complexity of the developing device.

Further, some users have requested the freedom to select an optimum developer cartridge from a plurality of developer cartridges in different price ranges corresponding to the amount of toner accommodated therein with consideration for cost and frequency of use.

To meet this demand, developer cartridges accommodating different amounts of toner must be provided. However, the toner accommodated in these developer cartridges has different agitation properties and different rates of degradation based on the amount of toner.

Under these circumstances, it is not sufficient merely to detect whether the developer cartridge is a new product since the life of the developer cartridge from this point of detection may differ according to the amount toner accommodated therein. Accordingly, the life of the developer cartridge cannot be accurately determined. As a result, a developer cartridge accommodating a small amount of toner may actually reach the end of its life before such a determination is made, resulting in a decline in image quality.

In view of the foregoing, it is an object of the invention to provide an image forming apparatus capable of determining information on a developer cartridge, while suppressing a rise in manufacturing costs and avoiding an increase in structural complexity. It is another object of the invention to provide a developer cartridge detachably mounted in the image forming apparatus.

In order to attain the above and other objects, according to one aspect, the invention provides an image forming apparatus. The image forming apparatus includes an apparatus main body, a driving-force generating portion, a developer cartridge, a detecting portion, and an information determining portion. The driving-force generating portion is disposed in the apparatus main body and generates a driving force. The developer cartridge is configured to be detachably mounted in the apparatus main body. The developer cartridge includes a drive member, a moving portion, and an interfering portion. The drive member is configured to be driven by the driving force and to move in a moving direction when the developer cartridge is mounted in the apparatus main body. The moving portion is provided on the drive member and is configured to move together with the drive member in the moving direction. The interfering portion is disposed downstream of a predetermined detection position with respect to the moving direction, thereby interfering with the moving portion and preventing the moving portion from passing the predetermined detection position a second time. The detecting portion detects passage of the moving portion at the predetermined detection position. The information determining portion determines information on the developer cartridge based on detection results of the detecting portion.

According to another aspect, the invention provides a developer cartridge configured to be detachably mounted in a main body of an image forming apparatus. The developer cartridge includes a drive member, a moving portion, and an interfering portion. The drive member is configured to be driven by a driving force and to move in a moving direction when the developer cartridge is mounted in the main body of the image forming apparatus. The moving portion is provided on the drive member and is configured to move together with the drive member in the moving direction. The interfering portion is disposed downstream of a predetermined detection position with respect to the moving direction, thereby interfering with the moving portion and preventing the moving portion from passing the predetermined detection position a second time.

BRIEF DESCRIPTION OF THE DRAWINGS

Illustrative aspects in accordance with the invention will be described in detail with reference to the following figures wherein.

DETAILED DESCRIPTION

<Overall Structure of Laser Printer>

Figure 1:
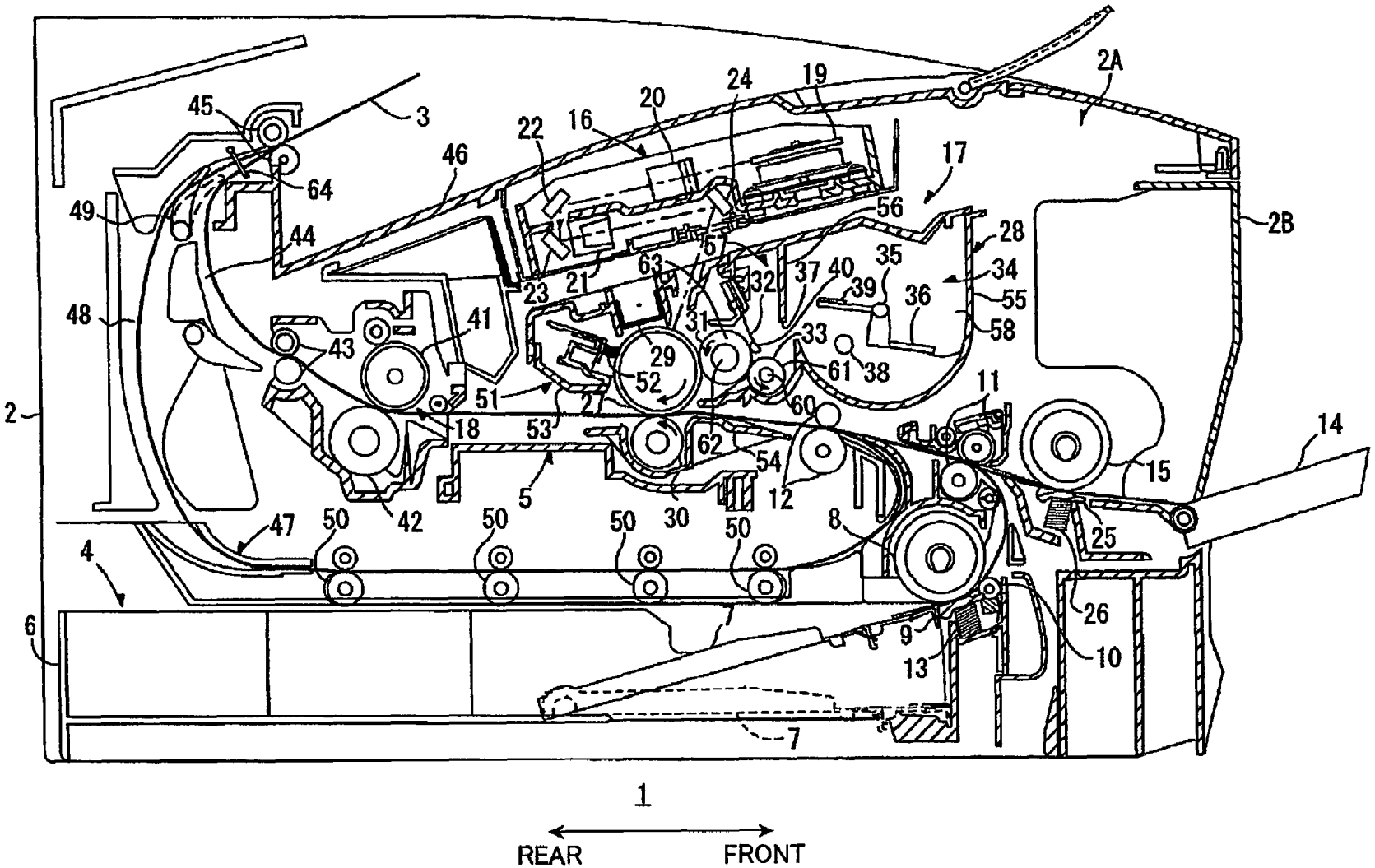
FIG. 1 is a side cross-sectional view of a laser printer according to illustrative aspects of the invention.

An image forming apparatus and a developer cartridge according to illustrative aspects of the invention will be described with reference to FIGS. 1 through 12. As shown in is FIG. 1, a laser printer 1 includes a main casing 2, a feeder unit 4, and an image forming unit 5. The feeder unit 4 and the image forming unit 5 are housed in the main casing 2. The feeder unit 4 supplies sheets 3 to the image forming unit 5. The image forming unit 5 forms desired images on the supplied sheets 3.

<Structure of Main Casing>

An access opening 2A is formed in one side surface (the right side in FIG. 1) of the main casing 2 for inserting and removing a process cartridge 17 described later. A front cover 2B is disposed on the side surface of the main casing 2 and is capable of opening and closing over the access opening 2A. The front cover 2B is rotatably supported by a cover shaft (not shown) inserted through a bottom end of the front cover 2B. When the front cover 2B is rotated closed about the cover shaft, the front cover 2B covers the access opening 2A, as shown in FIG. 1. When the front cover 2B is rotated open about the cover shaft (rotated downward), the access opening 2A is exposed, enabling the process cartridge 17 to be mounted into or removed from the main casing 2 via the access opening 2A.

In the following description, the "front" is used to define the side at which the front cover 2B is provided, and the "rear" is used to define the opposite side.

<Structure of Feeder Unit>

The feeder unit 4 is located within the lower section of the main casing 2 and includes a sheet supply tray 6, a sheet pressing plate 7, a sheet supply roller 8, a sheet supply pad 9, paper dust removing rollers 10, 11, and a pair of registration rollers 12. The sheet supply tray 6 is detachably mounted with respect to the main casing 2. The sheet pressing plate 7 is pivotally movably provided within the sheet supply tray 6. The sheet supply roller 8 and the sheet supply pad 9 are provided above one end of the sheet supply tray 6. The paper dust removing rollers 10, 11 are disposed downstream from the sheet supply roller 8 with respect to the direction in which the sheets 3 are transported. The registration rollers 12 are provided downstream from the paper dust removing rollers 10, 11 in the sheet transport direction of the sheets 3.

The sheet pressing plate 7 is capable of supporting a stack of sheets 3. The sheet pressing plate 7 is pivotally supported at its end furthest from the supply roller 8 so that the end of the sheet pressing plate 7 that is nearest the supply roller 8 can move vertically. Although not shown in the drawings, a spring for urging the sheet pressing plate 7 upward is provided to the rear surface of the sheet pressing plate 7. Therefore, the sheet pressing plate 7 pivots downward in accordance with increase in the amount of sheets 3 stacked on the sheet pressing plate 7. At this time, the sheet pressing plate 7 pivots around the end of the sheet pressing plate 7 farthest from the sheet supply roller 8, downward against the urging force of the spring. The sheet supply roller 8 and the sheet supply pad 9 are disposed in confrontation with each other. A spring 13 is provided beneath the sheet supply pad 9 for pressing the sheet supply pad 9 toward the sheet supply roller 8.

Urging force of the spring under the sheet pressing plate 7 presses the uppermost sheet 3 on the sheet pressing plate 7 toward the supply roller 8 so that rotation of the supply roller 8 moves the uppermost sheet 3 between the supply roller 8 and the separation pad 13. In this way, one sheet 3 at a time is separated from the stack and supplied to the paper dust removing rollers 10, 11.

The paper dust removing rollers 10, 11 remove paper dust from the supplied sheets 3 and further convey the same to the registration rollers 12. The pair of registration rollers 12 performs a desired registration operation on the supplied sheets 3. Then the sheets 3 are transported to an image formation position. In the image formation position a photosensitive drum 27 and a transfer roller 30 contact each other. In other words, the image formation position is a transfer position where the visible toner image is transferred from a surface of the photosensitive drum 27 to a sheet 3 as the sheet 3 passes between the photosensitive drum 27 and the transfer roller 30.

The feeder unit 4 further includes a multipurpose tray 14, a multipurpose sheet supply roller 15, and a multipurpose sheet supply pad 25. The multipurpose sheet supply roller 15 and the multipurpose sheet supply pad 25 are disposed in confrontation with each other and are for supplying sheets 3 that are stacked on the multipurpose tray 14. A spring 26 provided beneath the multipurpose sheet supply pad 25 presses the multipurpose sheet supply pad 25 up toward the multipurpose sheet supply roller 15.

Rotation of the multipurpose sheet supply roller 15 moves sheets 3 one at a time from the stack on the multipurpose tray 14 to a position between the multipurpose sheet supply pad 25 and the multipurpose sheet supply roller 15 so that the sheets 3 on the multipurpose tray 14 can be supplied one at a time to the image formation position.

<Structure of Image Forming Section>

The image forming section 5 includes a scanner section 16, a process cartridge 17, and affixing section 18.

<Structure of Scanner Section>

The scanner section 16 is provided at the upper section of the casing 2 and is provided with a laser emitting section (not shown), a rotatingly driven polygon mirror 19, lenses 20, 21, and reflection mirrors 22, 23, 24. The laser emitting section emits a laser beam based on desired image data. As indicated by single-dot chain line in FIG. 1, the laser beam passes through or is reflected by the mirror 19, the lens 20, the reflection mirrors 22 and 23, the lens 21, and the reflection mirror 24 in this order so as to irradiate, in a high speed scanning operation, the surface of the photosensitive drum 27 of the process cartridge 17.

<Structure of Process Cartridge>

The process cartridge 17 is disposed below the scanning unit 16 and includes a process frame 51 that is detachably mounted in the main casing 2. Within the process frame 51, the process cartridge 17 also includes a developer cartridge 28, the photosensitive drum 27, a Scorotron charger 29, an electrically conductive brush 52, and the transfer roller 30.

The process frame 51 includes an upper frame 53 and a lower frame 54. A paper-conveying path along which the sheets 3 are conveyed is formed between the upper frame 53 and lower frame 54. The upper frame 53 accommodates the photosensitive drum 27, charger 29, and brush 52. The developer cartridge 28 is detachably mounted on the upper frame 53. The lower frame 54 accommodates the transfer roller 30.

The photosensitive drum 27 is cylindrical in shape. The outermost surface of the photosensitive drum 27 is formed of a positive-charging photosensitive layer of polycarbonate or the like. The photosensitive drum 27 is supported on the upper frame 53 by a metal drum shaft (not shown) extending along the length of the photosensitive drum 27 through the axial center of the same. The photosensitive drum 27 is capable of rotating about the drum shaft in the process frame 51. Further, the photosensitive drum 27 is driven to rotate by a driving force inputted from a motor 59 (see FIG. 4).

The charger 29 is supported on the upper frame 53 and is disposed in opposition to the photosensitive drum 27 from a position above the same. The charger 29 is separated a predetermined distance from the photosensitive drum 27 so as not to contact the same. The charger 29 is a positive-charging Scorotron type charger that produces a corona discharge from a discharge wire formed of tungsten or the like in order to form a uniform charge of positive polarity over the surface of the photosensitive drum 27.

The transfer roller 30 is disposed in opposition to and in contact with the photosensitive drum 27 from a position below the same. The transfer roller 30 is supported on the lower frame 54 so as to be able to rotate in the direction indicated by the arrow (counterclockwise in FIG. 1). The transfer roller 30 is an ion-conducting transfer roller configured of a metal roller shaft covered by a roller that is formed of an electrically conductive rubber material. During a transfer operation, a transfer bias is applied to the transfer roller 30 by a constant current control. Further, the transfer roller 30 is driven to rotate by a driving force inputted from the motor 59.

The brush 52 is disposed in opposition to the photosensitive drum 27 on the rear side of the same (the left side in FIG. 1). The brush 52 is fixed to the upper frame 53 so that a free end of the brush 52 contacts the surface of the photosensitive drum 27.

The developer cartridge 28 includes a casing 55 and, within the casing 55, a developing roller 31, a thickness-regulating blade 32, and a supply roller 33.

The developer cartridge 28 is detachably mounted on the process frame 51. Hence, when the process cartridge 17 is mounted in the main casing 2, the developer cartridge 28 can be mounted in the main casing 2 by first opening the front cover 2B and subsequently inserting the developer cartridge 28 through the access opening 2A and mounting the developer cartridge 28 on the process cartridge 17.

The casing 55 has a box shape that is open on the rear side. A partitioning plate 56 is provided midway in the casing 55 in the front-to-rear direction for partitioning the interior of the casing 55. The front region of the casing 55 partitioned by the partitioning plate 56 serves as a toner-accommodating chamber 34 for accommodating toner, while the rear region of the casing 55 partitioned by the partitioning plate 56 serves as a developing chamber 57 in which are provided the developing roller 31, thickness-regulating blade 32, and supply roller 33. An opening 37 is formed below the partitioning plate 56 to allow the passage of toner in a front-to-rear direction.

The toner-accommodating chamber 34 is filled with positively charging, non-magnetic, single-component toner. In the present embodiment, polymerization toner is used as the toner. Polymerization toner has substantially spherical particles and so has an excellent fluidity characteristic. To produce polymerization toner, a polymerizing monomer is subjected to well-known copolymerizing processes, such as suspension polymerization. Examples of a polymerizing monomer include a styrene type monomer or an acrylic type monomer. An example of a styrene type monomer is styrene. Examples of acrylic type monomers are acrylic acid, alkyl (C1-C4) acrylate, and alkyl (C1-C4) metaacrylate. Because the polymerization toner has such an excellent fluidity characteristic, image development is reliably performed so that high-quality images can be formed. Materials such as wax and a coloring agent are distributed in the toner. The coloring agent can be carbon black, for example. In addition, external additive, such as silica, are added in the toner to further improve the fluidity characteristic. The toner has a particle diameter of about 6-10 μm.

An agitator rotational shaft 35 is disposed in the center of the toner-accommodating chamber 34. The agitator rotational shaft 35 is rotatably supported in side walls 58 (see FIG. 4) of the casing 55. The side walls 58 confront each other laterally (direction orthogonal to the front-to-rear direction and vertical direction) but are separated from each other by a predetermined distance. An agitator 36 is disposed on the agitator rotational shaft 35. The motor 59 (see FIG. 4) produces a driving force that is inputted into the agitator rotational shaft 35 for driving the agitator 36 to rotate. When driven to rotate, the agitator 36 stirs the toner inside the toner-accommodating chamber 34 so that some of the toner is discharged toward the supply roller 33 through the opening 37 formed below the partitioning plate 56.

Toner detection windows 38 (see FIG. 4) are provided in both side walls 58 of the casing 55 at positions corresponding to the toner-accommodating chamber 34 for detecting the amount of toner remaining in the toner-accommodating chamber 34. The toner detection windows 38 oppose each other laterally across the toner-accommodating chamber 34. A light-emitting element (not shown) is provided on the main casing 2 outside one of the toner detection windows 38, while a light-receiving element (not shown) is provided on the main casing 2 outside the other of the toner detection windows 38. Light emitted from the light-emitting element passes into the toner-accommodating chamber 34 through one of the toner detection windows 38. The light-receiving element detects this light as a detection light when the light passes through the toner-accommodating chamber 34 and exits the other toner detection window 38. The laser printer 1 can determine the amount of remaining toner based on these detection results. Further, a cleaner 39 is supported on the agitator rotational shaft 35 for cleaning the toner detection windows 38.

The supply roller 33 is disposed rearward of the opening 37 and includes a metal supply roller shaft 60 covered by a sponge roller 61 formed of an electrically conductive foam material. The metal supply roller shaft 60 is rotatably supported in both side walls 58 of the casing 55 at a position corresponding to the developing chamber 57. The supply roller 33 is driven to rotate by a driving force inputted into the metal supply roller shaft 60 from the motor 59.

The developing roller 31 is disposed rearward of the supply roller 33 and contacts the supply roller 33 with pressure so that both are compressed. The developing roller 31 includes a metal developing roller shaft 62, and a rubber roller 63 formed of an electrically conductive rubber material that covers the metal developing roller shaft 62. The metal developing roller shaft 62 is rotatably supported in both side walls 58 of the casing 55 at a position corresponding to the developing chamber 57. The rubber roller 63 is more specifically formed of an electrically conductive urethane rubber or silicon rubber containing fine carbon particles, the surface of which is coated with urethane rubber or silicon rubber containing fluorine. The developing roller 31 is driven to rotate by a driving force inputted into the metal developing roller shaft 62 from the motor 59. A developing bias is applied to the developing roller 31 during a developing operation.

The layer thickness regulating blade 32 is disposed near the developing roller 31. The layer thickness regulating blade 32 includes a blade made from a metal leaf spring, and has a pressing member 40, that is provided on a free end of the blade. The pressing member 40 has a semi-circular shape when viewed in cross section. The pressing member 40 is formed from silicone rubber with electrically insulating properties. The layer thickness regulating blade 32 is supported by the casing 55 at a location near the developing roller 31. The resilient force of the blade presses the pressing member 40 against the surface of the developing roller 31.

Then rotation of the supply roller 33 supplies the developing roller 31 with the toner that has been discharged through the opening 37. At this time, the toner is triboelectrically charged to a positive charge between the supply roller 33 and the developing roller 31. Then, as the developing roller 31 rotates, the toner supplied onto the developing roller 31 moves between the developing roller 31 and the pressing member 40 of the layer thickness regulating blade 32. This reduces thickness of the toner on the surface of the developing roller 31 down to a thin layer of uniform thickness.

As the photosensitive drum 27 rotates, the charger 29 charges the surface of the photosensitive drum 27 with a uniform positive polarity. Subsequently, the scanning unit 16 irradiates a laser beam over the positively charged surface of the casing 55 in a high-speed scan to form an electrostatic latent image corresponding to an image to be formed on the sheet 3.

Next, an inverse developing process is performed. That is, as the developing roller 31 rotates, the positively-charged toner borne on the surface of the developing roller 31 is brought into contact with the photosensitive drum 27. At this time, the toner on the developing roller 31 is supplied to lower-potential areas of the electrostatic latent image on the photosensitive drum 27. As a result, the toner is selectively borne on the photosensitive drum 27 so that the electrostatic latent image is developed into a visible toner image.

Subsequently, as the registration rollers 12 convey a sheet 3 through the transfer position between the photosensitive drum 27 and transfer roller 30, the toner image carried on the surface of the photosensitive drum 27 is transferred onto the sheet 3 due to the transfer bias applied to the transfer roller 30. After the toner image is transferred, the sheet 3 is conveyed to the fixing unit 18.

During the transfer operation, paper dust is deposited on the surface of the photosensitive drum 27 when the photosensitive drum 27 contacts the sheet 3. As the photosensitive drum 27 continues to rotate after the transfer operation, the brush 52 removes this paper dust from the surface of the photosensitive drum 27 as the surface of the photosensitive drum 27 rotates opposite the brush 52.

In the laser printer 1, residual toner which is left on the surface of the photosensitive drum 27 after a transfer to the sheet 3 is recovered by the developing roller 31. That is, the residual toner is recovered using a so-called cleanerless method. By recovering the residual toner using the cleanerless method, a toner cleaning device and a used-toner reservoir become unnecessary, which simplifies the construction of the device.

<Structure of Fixing Section>

As shown in FIG. 1, the fixing section 18 is disposed downstream from the process cartridge 17 and includes a heat roller 41, a pressing roller 42, and transport rollers 43. The pressing roller 42 presses against the heat roller 41. The transport rollers 43 are provided downstream from the heat roller 41 and the pressing roller 42.

The heat roller 41 includes a metal tube and a halogen lamp disposed therein. The halogen lamp heats up the metal tube so that toner that has been transferred onto sheet 3 in the process cartridge 17 is thermally fixed onto the sheet 3 as the sheet 3 passes between the heat roller 41 and the pressing roller 42. Afterward, the sheet 3 is transported to a sheet-discharge path 44 by the transport rollers 43 and discharged onto a sheet-discharge tray 46 by sheet-discharge rollers 45.

<Structure of Both-Side Printing Mechanism>

The laser printer 1 is further provided with an inverting transport unit 47 (both-side printing mechanism) for inverting sheets 3 that have been printed on once and for returning the sheets 3 to the image forming unit 5 so that images can be formed on both sides of the sheets 3. The inverting transport unit 47 includes the sheet-discharge rollers 45, an inversion transport path 48, a flapper 49, and a plurality of inversion transport rollers 50.

The sheet-discharge rollers 45 are a pair of rollers that can be rotated selectively forward or in reverse. The sheet-discharge rollers 45 are rotated forward to discharge sheets 3 onto the sheet-discharge tray 46 and rotated in reverse when sheets are to be inverted.

The inversion transport rollers 50 are disposed below the image forming unit 5. The inversion transport path 48 extends vertically between the sheet-discharge rollers 45 and the inversion transport rollers 50. The upstream end of the inversion transport path 48 is located near the sheet-discharge rollers 45 and the downstream end is located near the inversion transport rollers 50 so that sheets 3 can be transported downward from the sheet-discharge rollers 45 to the inversion transport rollers 50.

The flapper 49 is swingably disposed at the junction between the sheet-discharge path 44 and the inversion transport path 48. By activating or deactivating a solenoid (not shown), the flapper 49 can be selectively swung between the orientation shown in broken line and the orientation shown by solid line in FIG. 1. The orientation shown in solid line in FIG. 1 is for transporting sheets 3 that have one side printed to the sheet-discharge rollers 45. The orientation shown in broken line in FIG. 1 is for transporting sheets from the sheet-discharge rollers 45 into the inversion transport path 48, rather than back into the sheet-discharge path 44.

The inversion transport rollers 50 are aligned horizontally at positions above the sheet supply tray 6. The pair of inversion transport rollers 50 that is farthest upstream is disposed near the rear end of the inversion transport path 48. The pair of inversion transport rollers 50 that is located farthest downstream is disposed below the registration rollers 12.

The inverting transport unit 47 operates in the following manner when a sheet 3 is to be formed with images on both sides. A sheet 3 that has been formed on one side with an image is transported by the transport rollers 43 from the sheet-discharge path 44 to the sheet-discharge rollers 45. The sheet-discharge rollers 45 rotate forward with the sheet 3 pinched therebetween until almost all of the sheet 3 is transported out from the laser printer 1 and over the sheet-discharge tray 46. The forward rotation of the sheet-discharge rollers 45 is stopped once the rear-side end of the sheet 3 is located between the sheet-discharge rollers 45. Then, the sheet-discharge rollers 45 are driven to rotate in reverse while at the same time the flapper 49 is switched to change transport direction of the sheet 3 toward the inversion transport path 48. As a result, the sheet 3 is transported into the inversion transport path 48. The flapper 49 reverts to its initial position once transport of the sheet 3 to the inversion transport path 48 is completed. That is, the flapper 49 switches back to the position for transporting sheets from the transport rollers 43 to the sheet-discharge rollers 45.

Next, the inverted sheet 3 is transported through the inversion transport path 48 to the inversion transport rollers 50 and then upward from the inversion transport rollers 50 to the registration rollers 12. The registration rollers 12 align the front edge of the sheet 3. Afterward, the sheet 3 is transported toward the image formation position. At this time, the upper and lower surfaces of the sheet 3 are reversed from the first time that an image has been formed on the sheet 3 so that an image can be formed on the other side as well. In this way, images are formed on both sides of the sheet 3.

A paper discharge sensor 64 is disposed along the paper discharge path 44 upstream of the discharge rollers 45. The paper discharge sensor 64 pivots each time a sheet 3 conveyed along the paper discharge path 44 in the discharge direction passes the paper discharge sensor 64. A CPU 100 (see FIG. 4) provided in the main casing 2 counts the number of times that the paper discharge sensor 64 pivots and stores this number as the number of printed sheets.

In the laser printer 1 having this construction, the CPU 100 determines whether the developer cartridge 28 mounted in the main casing 2 is a new product and determines the maximum number of sheets to be printed with the developer cartridge 28 when the developer cartridge 28 is new, as will be described later. The CPU 100 compares the actual number of printed sheets since the new developer cartridge 28 was mounted with the maximum number of sheets to be printed with the developer cartridge 28 and displays an out-of-toner warning on a control panel or the like (not shown) when the actual number of printed sheets approaches the maximum number of sheets to be printed.

<Structure for Detecting a New Developer Cartridge According to Illustrative Aspects>

Figure 2:
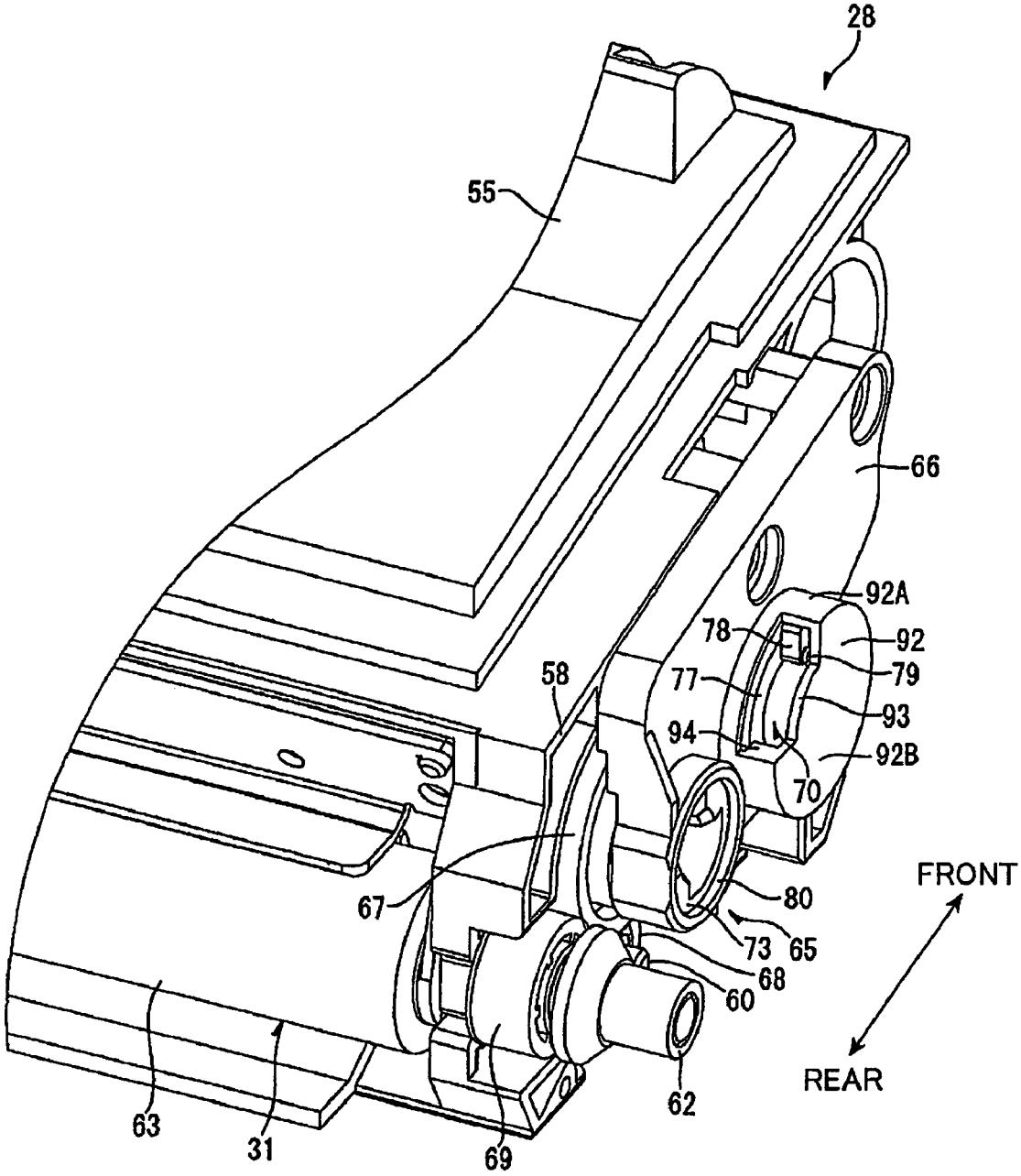
FIG. 2 is a perspective view of a developer cartridge according to the illustrative aspects, when a gear cover is mounted there.
Figure 3:
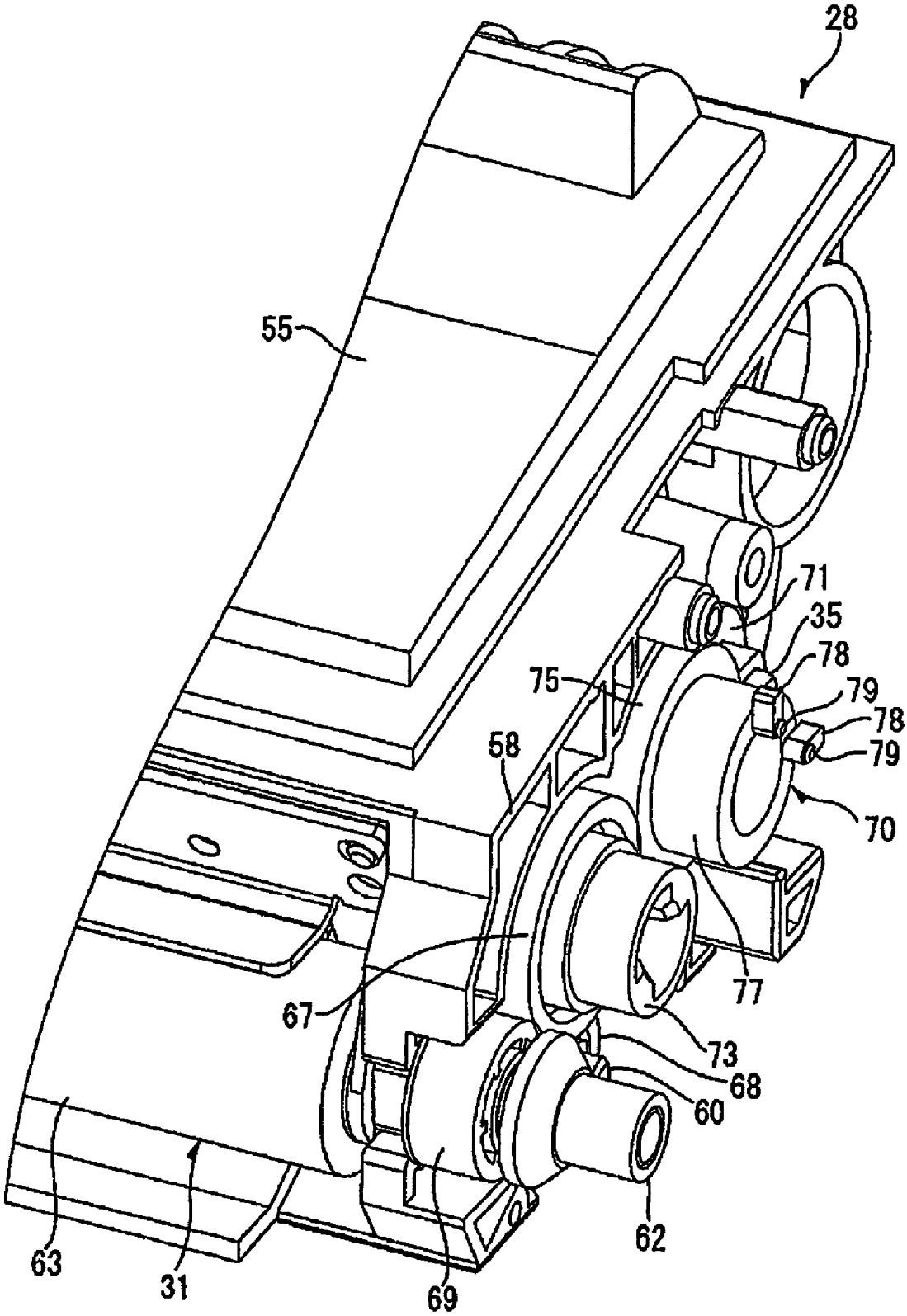
FIG. 3 is a perspective view of the developer cartridge according to the illustrative aspects, when the gear cover has been removed.
Figure 4:
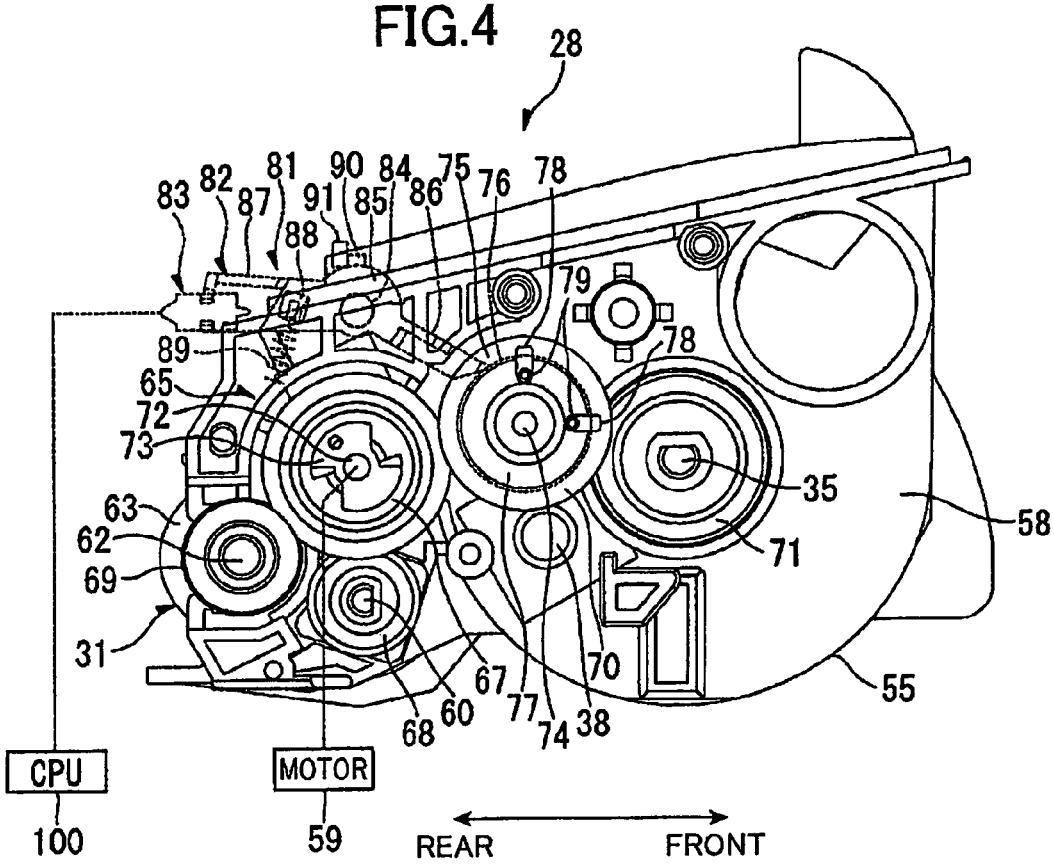
FIG. 4 is a side view of the developer cartridge according to the illustrative aspects, when the gear cover has been removed.

FIG. 2 is a perspective view of the developer cartridge according to the illustrative aspects when a gear cover is mounted. FIG. 3 is a perspective view of the developer cartridge according to the illustrative aspects when the gear cover has been removed. FIG. 4 is a side view of the developer cartridge according to the illustrative aspects when the gear cover has been removed. FIGS. 5 through 11 are side cross-sectional views of the developer cartridge according to the illustrative aspects when the gear cover is attached thereto, illustrating a mechanism for detecting a new product.

As shown in FIG. 4, the developer cartridge 28 includes a gear mechanism 65 for rotating the agitator rotational shaft 35 of the agitator 36, the metal supply roller shaft 60 of the supply roller 33, and the metal developing roller shaft 62 of the developing roller 31; and a gear cover 66 for covering the gear mechanism 65, as shown in FIG. 2.

The gear mechanism 65 is disposed on one of the side walls 58 configuring the casing 55 of the developer cartridge 28. The gear mechanism 65 includes an input gear 67, a supply roller drive gear 68, a developer roller drive gear 69, an intermediate gear 70, and an agitator drive gear 71.

The input gear 67 is disposed between the metal developing roller shaft 62 and the agitator rotational shaft 35 and is rotatably supported on an input gear support shaft 72 that protrudes laterally from the outer side of one side wall 58. A coupling receiving part 73 is disposed in the axial center of the input gear 67 for inputting a driving force from the motor 59 provided in the main casing 2 when the developer cartridge 28 is mounted in the main casing 2.

The supply roller drive gear 68 is disposed below the input gear 67 on an axial end of the metal supply roller shaft 60 so as to be engaged with the input gear 67. The supply roller drive gear 68 is incapable of rotating relative to the metal supply roller shaft 60.

The developer roller drive gear 69 is disposed diagonally below and rearward of the input gear 67 on an end of the metal developing roller shaft 62 so as to be engaged with the input gear 67. The developer roller drive gear 69 is incapable of rotating relative to the metal developing roller shaft 62.

The intermediate gear 70 is rotatably supported in front of the input gear 67 on an intermediate gear support shaft 74. The intermediate gear support shaft 74 protrudes laterally from the outer side of one side wall 58. The intermediate gear 70 is a two-stage gear integrally formed of outer teeth 75 that engage with the input gear 67, and inner teeth 76 that engage with the agitator drive gear 71.

The agitator drive gear 71 is disposed diagonally in front of and below the intermediate gear 70 on an axial end of the agitator rotational shaft 35. The agitator drive gear 71 is incapable of rotating relative to the agitator rotational shaft 35.

When the developer cartridge 28 is mounted in the main casing 2, the motor 59 is linked to the coupling receiving part 73 in the developer cartridge 28. Accordingly, the input gear 67 is rotated when the motor 59 is driven. When the input gear 67 is rotated, the supply roller drive gear 68, developer roller drive gear 69, and intermediate gear 70, directly linked to the input gear 67 and the agitator drive gear 71 linked to the input gear 67 via the intermediate gear 70 also rotate.

A cylindrical part 77 is formed on the intermediate gear 70, protruding laterally outward from an end face of the outer teeth 75 on the side opposite of the inner teeth 76. Two moving members 78 are attached to an end face of the cylindrical part 77 on the opposite side from the outer teeth 75. Each moving member 78 is substantially rod-shaped and has a base end and a distal end. The base end of each moving member 78 is pivotally supported on a pivot shaft 79 protruding laterally outward from the end face of the cylindrical part 77 opposite the side of the outer teeth 75. The distal end of each moving member 78 extends outward along a radial direction of the intermediate gear support shaft 74. The two pivot shafts 79 supporting the two moving members 78 are disposed on the end face of the cylindrical part 77 at an interval that forms an angle of about 90°0 with respect to the intermediate gear support shaft 74.

The moving member 78 can pass a detection position (passing position) described later without being hindered by a contact pawl 86 described later, even if the moving member 78 contacts the contact pawl 86 at the detection position. The moving member 78 is coupled to the pivot shaft 79 with an appropriate frictional force that allows the moving member 78 to pivot when contacting an interference protrusion 94 described later.

The number of provided moving members 78 corresponds to information on the developer cartridge 28 relating to the amount of toner accommodated in the toner-accommodating chamber 34 when the developer cartridge 28 is new. In other words, the number of moving members 78 corresponds to information on the maximum number of sheets 3 on which images can be formed with the amount of toner accommodated in the toner-accommodating chamber 34 (hereinafter referred to as the maximum number of sheets to be printed).

More specifically, when two moving members 78 are provided, as in the example of FIGS. 3 and 4, the number of moving members 78 corresponds to information indicating that the maximum number of sheets to be printed is 6000. When only one moving member 78 is provided, the number of moving members 78 corresponds to information indicating that the maximum number of sheets to be printed is 3000.

As shown in FIG. 2, the gear cover 66 is mounted on one of the side walls 58 of the developer cartridge 28 for covering the gear mechanism 65. An opening 80 is formed in the rear side of the gear cover 66 for exposing the coupling receiving part 73. Further, an intermediate gear cover 92 is formed on the front side of the gear cover 66 for covering the intermediate gear 70.

The intermediate gear cover 92 is integrally provided with a peripheral wall 92A substantially cylindrical in shape and protruding laterally outward from the gear cover 66 in order to accommodate the intermediate gear 70; and an end face wall 92B for covering the outer end face of the peripheral wall 92A in the latitudinal direction. A sensing window 93 is formed as an opening along the circumferential direction of the peripheral wall 92A in the upper rear part of the intermediate gear cover 92. The sensing window 93 exposes the distal ends of the moving members 78 that move circumferentially together with the rotation of the intermediate gear 70.

Figure 5:
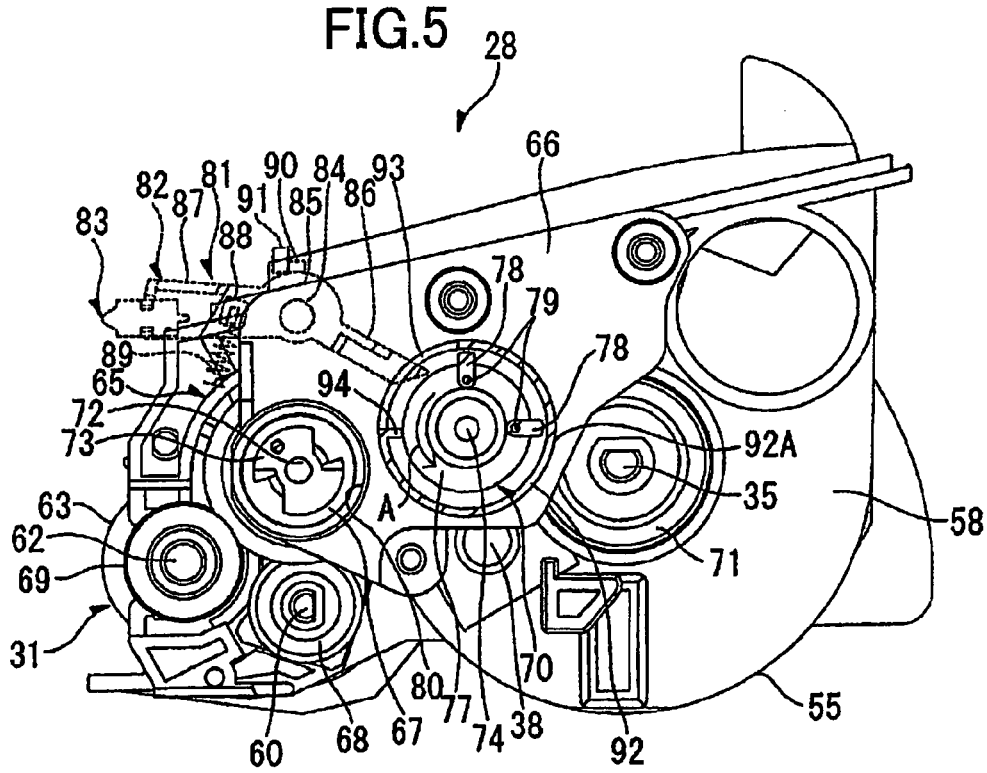
FIG. 5 is a side cross-sectional view of the developer cartridge (with the gear cover mounted) according to the illustrative aspects illustrating a mechanism for detecting a new product, when the developer cartridge is mounted in a main casing.

As shown in FIG. 5, the interference protrusion 94 is formed on a lower edge of the sensing window 93 and extends rearward into the intermediate gear cover 92. The interference protrusion 94 is disposed downstream of the detection position with respect to the moving direction of the moving members 78.

An information-detecting mechanism 81 and the CPU 100 are provided on the main casing 2. The information-detecting mechanism 81 detects passage of the moving members 78. The CPU 100 determines information on the developer cartridge 28 mounted in the main casing 2 based on the number of times the information-detecting mechanism 81 detects the moving members 78. More specifically, the CPU 100 determines whether the mounted developer cartridge 28 is new, and the maximum number of sheets to be printed with the developer cartridge 28 when the developer cartridge 28 is a new product, as described above.

The information-detecting mechanism 81 is provided on an inner wall (not shown) of the main casing 2 laterally outside the developer cartridge 28 when the developer cartridge 28 is mounted in the main casing 2, as shown in FIG. 4. The information-detecting mechanism 81 includes an actuator 82, and an optical sensor 83.

The actuator 82 is pivotally supported on a pivot shaft 84 protruding laterally inward from the inner surface of the main casing 2. The actuator 82 is integrally provided with a cylindrical insertion part 85 through which the pivot shaft 84 is inserted, the contact pawl 86 extending forward from the cylindrical insertion part 85 as a contact part, and a light-blocking part 87 extending rearward from the cylindrical insertion part 85.

As shown in FIG. 4, the contact pawl 86 slopes slightly downward when the light-blocking part 87 is extending substantially along the horizontal direction. The light-blocking part 87 is formed with a thickness in the vertical direction capable of blocking detection light emitted from the optical sensor 83.

A spring engaging part 88 is formed on the light-blocking part 87 at a point midway along the length thereof. One end of a tension spring 89 is engaged in the spring engaging part 88. The tension spring 89 extends downward from the spring engaging part 88, with the other end fixed to the inner surface of the main casing 2 (not shown).

A protruding stopper 90 is formed on the peripheral surface of the cylindrical insertion part 85, protruding radially outward from the top side thereof. A stopper contact part 91 is provided on the main casing 2 near the rear side of the protruding stopper 90 for contacting the same. As shown in FIG. 4, the light-blocking part 87 of the actuator 82 is constantly urged downward by the tension spring 89. The urging force is restricted by the protruding stopper 90 contacting the stopper contact part 91. In this state, the actuator 82 is maintained such that the light-blocking part 87 extends substantially along the horizontal direction, while the contact pawl 86 slopes slightly downward toward the front side. In this state, the contact pawl 86 of the actuator 82 is disposed in the detection position at which the information-detecting mechanism 81 detects passage of the moving members 78, that is, the position at which the moving members 78 pass the information-detecting mechanism 81.

As will be described later, the contact pawl 86 of the actuator 82 is pressed downward when the moving members 78 contact the contact pawl 86 at the detection position. Accordingly, the light-blocking part 87 pivots upward and the contact pawl 86 pivots downward about the cylindrical insertion part 85 in opposition to the urging force of the tension spring 89 (see FIGS. 6 and 8). As a result, the protruding stopper 90 separates from the stopper contact part 91. Subsequently, when contact between the moving member 78 and contact pawl 86 is broken, the urging force of the tension spring 89 causes the light-blocking part 87 to pivot downward and the contact pawl 86 to pivot upward about the cylindrical insertion part 85 until the protruding stopper 90 contacts the stopper contact part 91 (see FIGS. 7 and 9).

While not shown in the drawings, the optical sensor 83 is provided in a holder member substantially U-shaped in a plan view and open on one end so that a light-emitting element and light-receiving element of the optical sensor 83 oppose each other with a gap therebetween. The optical sensor 83 is positioned such that the light-blocking part 87 of the actuator 82 is interposed between the holder member. More specifically, the optical sensor 83 is disposed such that the light-blocking part 87 blocks detection light emitted from the light-emitting element toward the light-receiving element when the actuator 82 is in its normal state (see FIG. 5), while the detection light emitted from the light-emitting element toward the light-receiving element is received by the light-receiving element when the moving member 78 contacts the contact pawl 86 and causes the light-blocking part 87 to pivot upward, as described above (see FIGS. 6 and 8).

<Operations for Detecting a New Developer Cartridge According to the Illustrative Aspects>

Next, a method will be described for determining whether a developer cartridge 28 mounted in the main casing is new or old and for determining the maximum number of sheets to be printed by the developer cartridge 28.

In this method, the front cover 2B is first opened, and the process cartridge 17 on which the new developer cartridge 28 is mounted is inserted into the main casing 2 through the access opening 2A. Alternatively, the front cover 2B is opened and the new developer cartridge 28 is inserted through the access opening 2A and mounted on the process cartridge 17 already mounted in the main casing 2.

As shown in FIG. 5, two of the moving members 78 are provided on the intermediate gear 70 in the developer cartridge 28. When the developer cartridge 28 is new, the moving members 78 are disposed to extend along radial directions of the intermediate gear support shaft 74 (first position), as shown in FIG. 5. Also, the moving members 78 are positioned upstream of the detection position. Accordingly, the moving members 78 do not contact the contact pawl 86 of the actuator 82 when the developer cartridge 28 is mounted in the main casing 2, and the actuator 82 is maintained in its normal state with the light-blocking part 87 blocking the detection light of the optical sensor 83.

Further, when the developer cartridge 28 is mounted in the main casing 2, a coupling insertion part (not shown) for transferring a driving force from the motor 59 provided in the main casing 2 is inserted into the coupling receiving part 73 of the input gear 67 in the developer cartridge 28. As a result, the driving force from the motor 59 drives the input gear 67, supply roller drive gear 68, developer roller drive gear 69, intermediate gear 70, and agitator drive gear 71 of the gear mechanism 65.

Next, when the developer cartridge 28 is mounted in the main casing 2, the CPU 100 initiates a warm-up operation in which an operation is executed to idly rotate the agitator 36.

In this idle rotation operation, the CPU 100 drives the motor 59 provided in the main casing 2. The driving force of the motor 59 is inputted from the coupling insertion part into the input gear 67 of the developer cartridge 28 via the coupling receiving part 73 and drives the input gear 67 to rotate. At this time, the supply roller drive gear 68 engaged with the input gear 67 is driven to rotate. The rotation of the metal supply roller shaft 60 in turn rotates the supply roller 33. Further, the developer roller drive gear 69 engaged with the input gear 67 is driven to rotate, and the rotation of the metal developing roller shaft 62 in turn rotates the developing roller 31. Further, the intermediate gear 70 engaged with the input gear 67 via the outer teeth 75 is driven to rotate, causing the inner teeth 76 formed integrally with the outer teeth 75 to rotate. When the inner teeth 76 of the intermediate gear 70 rotate, the agitator drive gear 71 engaged with the inner teeth 76 is driven to rotate. The rotation of the agitator rotational shaft 35 rotates the agitator 36, which stirs the toner in the toner-accommodating chamber 34 and generates a flow of toner.

Figure 6:
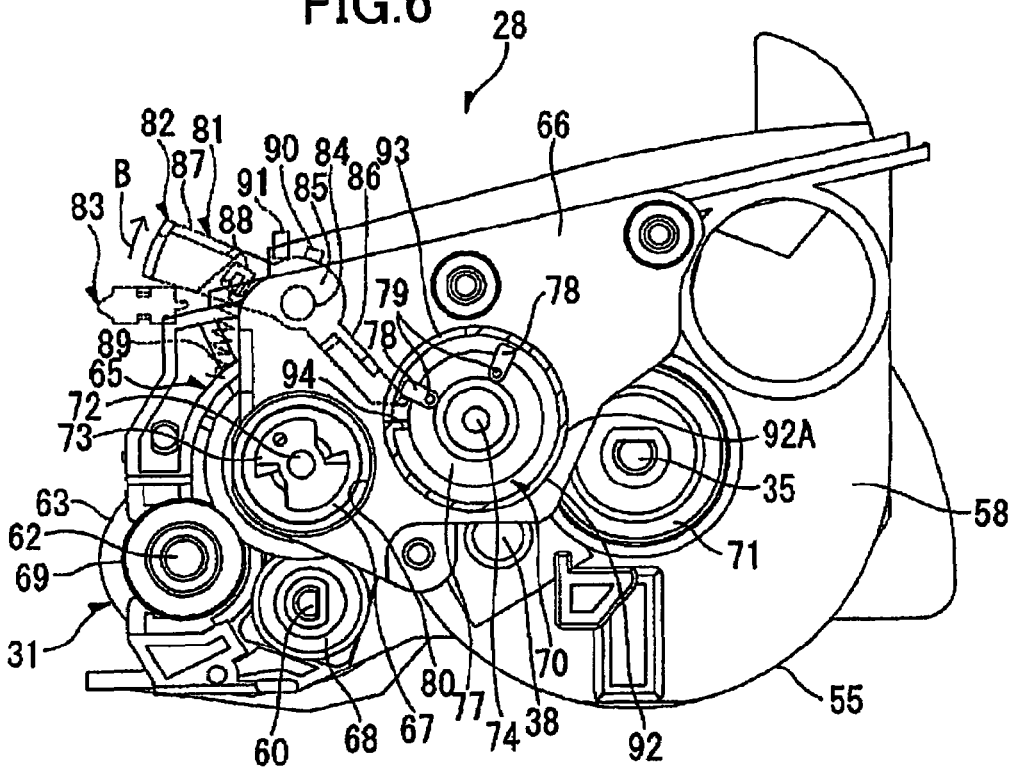
FIG. 6 is a side cross-sectional view of the developer cartridge (with the gear cover mounted) according to the illustrative aspects illustrating the mechanism for detecting a new product, when a front moving member is in contact with an actuator.

When the intermediate gear 70 is driven to rotate, the moving members 78 mounted on the cylindrical part 77 move in a circumferential direction A (counterclockwise in FIG. 5). At this time, as shown in FIG. 6, the distal end of the leading (front) moving member 78 contacts the contact pawl 86 of the actuator 82 at the detection position in a downward motion. The actuator 82 pivots around the cylindrical insertion part 85 against the urging force of the tension spring 89 so that the contact pawl 86 moves downward and the light-blocking part 87 moves upward, as indicated by the arrow B in FIG. 6. Hence, the light-receiving element receives the detection light from the optical sensor 83, which detection light was previously blocked by the light-blocking part 87 when the actuator 82 was in its normal state. The optical sensor 83 transmits a reception signal based on the received light to the CPU 100. The CPU 100 recognizes the reception signal as the first reception signal and resets the number of printed sheets that is detected by the paper discharge sensor 64.

Figure 7:
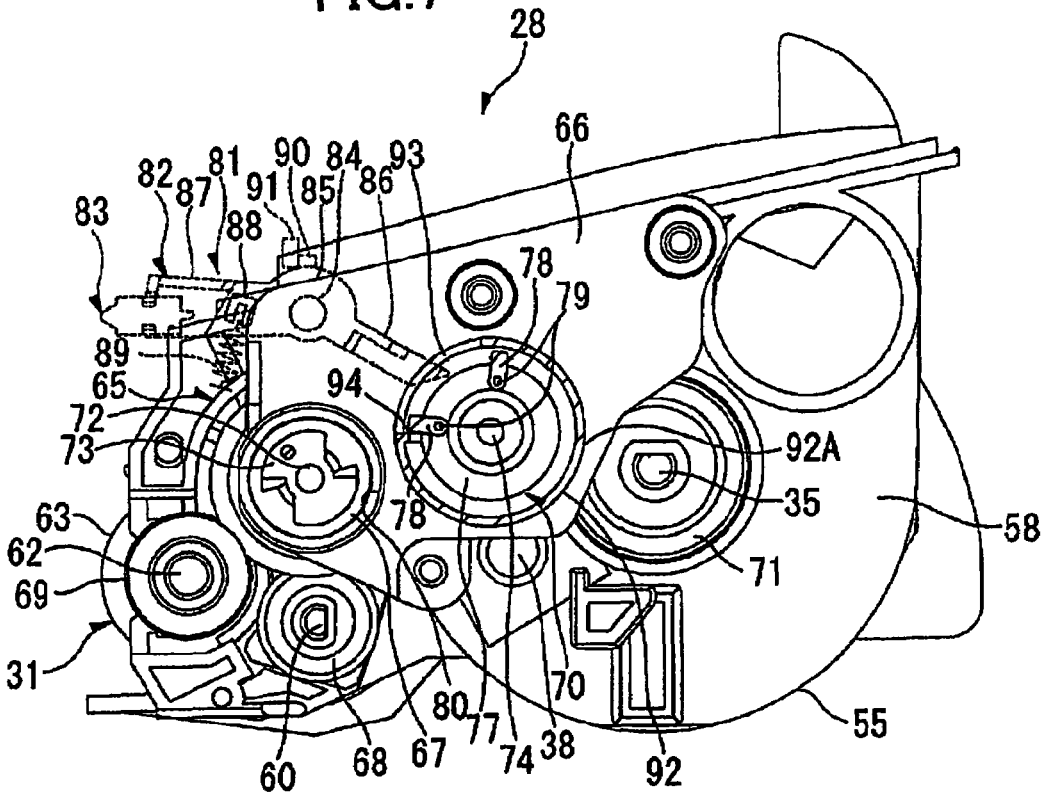
FIG. 7 is a side cross-sectional view of the developer cartridge (with the gear cover mounted) according to the illustrative aspects illustrating the mechanism for detecting a new product, when the front moving member is in contact with an interference protrusion.

As the intermediate gear 70 is further driven to rotate, the distal end of the leading moving member 78 further presses the contact pawl 86 while sliding along the contact pawl 86 and subsequently passes and separates from the contact pawl 86, as shown in FIG. 7. Accordingly, when contact between the moving member 78 and contact pawl 86 is removed, the urging force of the tension spring 89 causes the actuator 82 to pivot about the cylindrical insertion part 85 in the opposite direction of the arrow B in FIG. 6 so that the contact pawl 86 moves upward and the light-blocking part 87 moves downward until the actuator 82 returns to its normal state. At this time, the light-blocking part 87 once again blocks the detection light of the optical sensor 83 that had been received by the light-receiving element.

Figure 8:
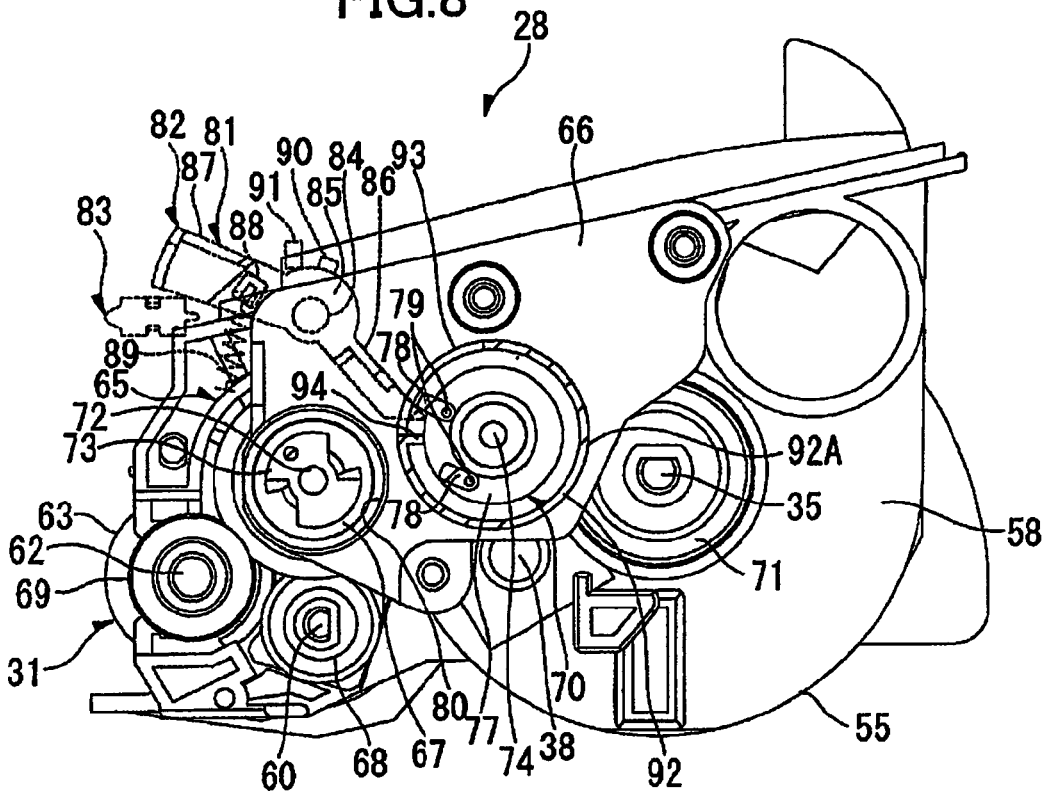
FIG. 8 is a side cross-sectional view of the developer cartridge (with the gear cover mounted) according to the illustrative aspects illustrating the mechanism for detecting a new product, when a rear moving member is in contact with the actuator.

When the intermediate gear 70 is further driven to rotate, the distal end of the trailing (rear) moving member 78 contacts the contact pawl 86 of the actuator 82 at the detection position in a downward motion, as shown in FIG. 8. The actuator 82 pivots around the cylindrical insertion part 85 against the urging force of the tension spring 89 so that the contact pawl 86 moves downward and the light-blocking part 87 moves upward, as indicated by the arrow B in FIG. 6. Hence, the light-receiving element receives the detection light from the optical sensor 83, which detection light was previously blocked by the light-blocking part 87 when the actuator 82 was in its normal state. The optical sensor 83 transmits a reception signal based on the received light to the CPU 100. The CPU 100 recognizes the reception signal as the second reception signal.

Figure 9:
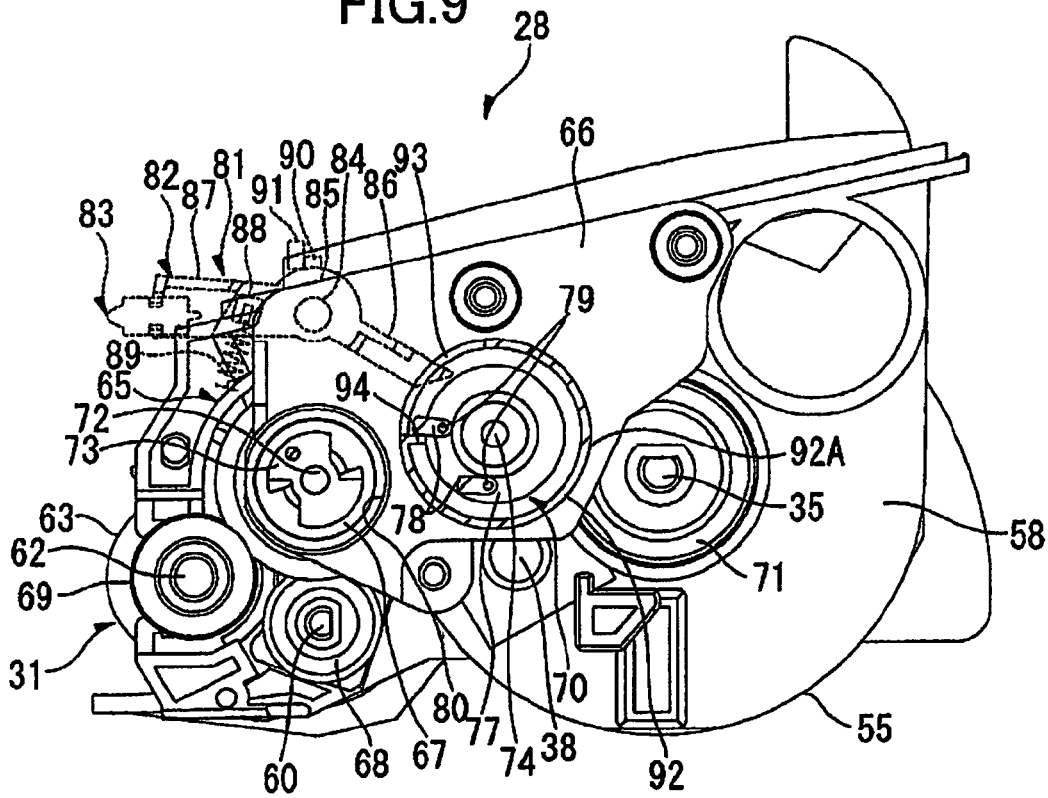
FIG. 9 is a side cross-sectional view of the developer cartridge (with the gear cover mounted) according to the illustrative aspects illustrating the mechanism for detecting a new product, when the rear moving member is in contact with the interference protrusion.
Figure 10:
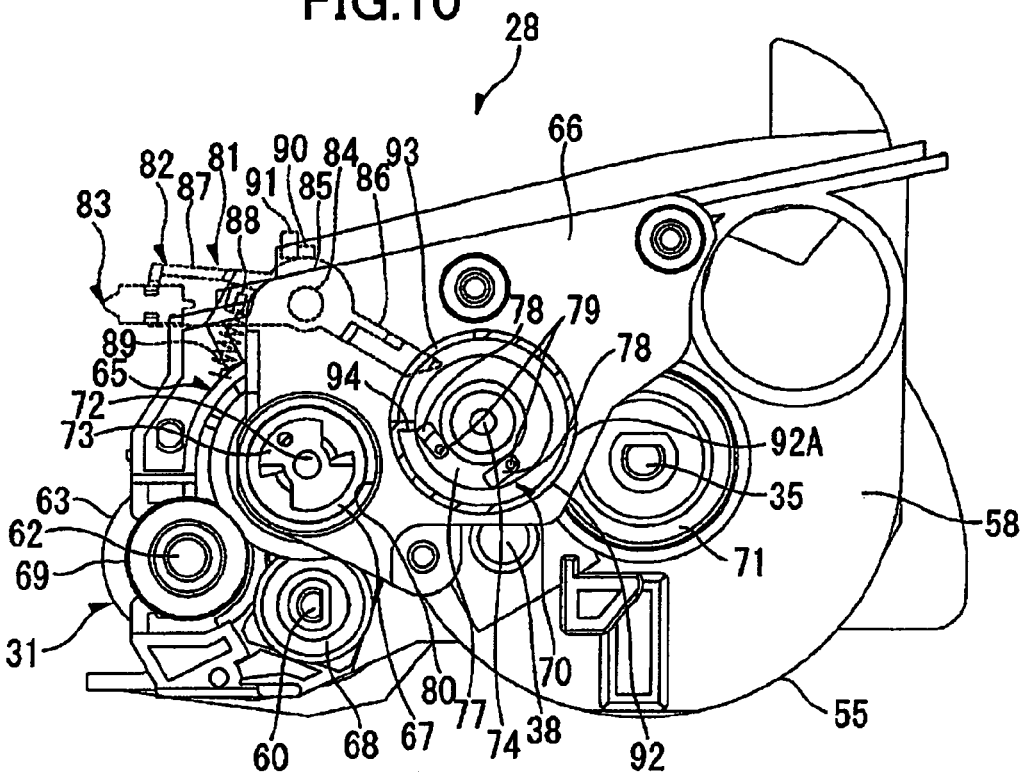
FIG. 10 is a side cross-sectional view of the developer cartridge (with the gear cover mounted) according to the illustrative aspects illustrating the mechanism for detecting a new product, when the rear moving member has passed the interference protrusion.
Figure 11:
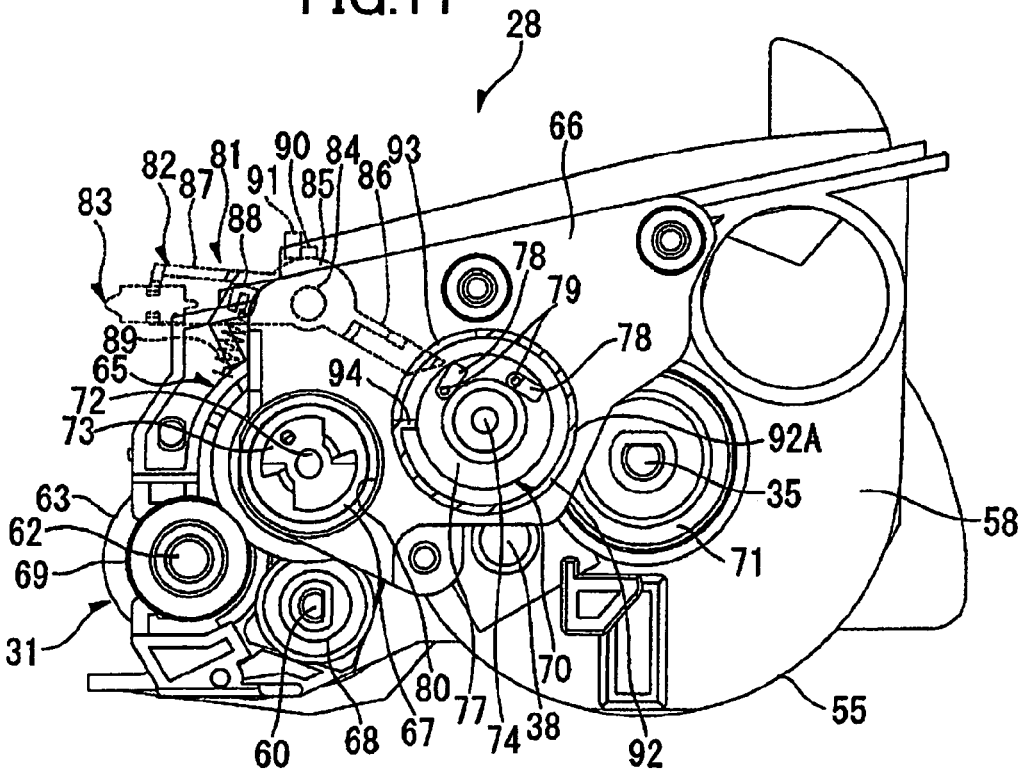
FIG. 11 is a side cross-sectional view of the developer cartridge (with the gear cover mounted) according to the illustrative aspects illustrating the mechanism for detecting a new product, when the front moving member has made one circuit and come adjacent to the actuator.

As the intermediate gear 70 is further driven to rotate, the distal end of the trailing (rear) moving member 78 further presses the contact pawl 86 while sliding along the contact pawl 86 and subsequently passes and separates from the contact pawl 86, as shown in FIG. 9. Accordingly, when contact between the moving member 78 and contact pawl 86 is removed, the urging force of the tension spring 89 causes the actuator 82 to pivot about the cylindrical insertion part 85 in the opposite direction of the arrow B in FIG. 6 so that the contact pawl 86 moves upward and the light-blocking part 87 moves downward until the actuator 82 returns to its normal state. At this time, the light-blocking part 87 once again blocks the detection light of the optical sensor 83 that had been received by the light-receiving element.

As shown in FIGS. 7 and 9, after each of the moving members 78 has passed the detection position, the distal end of each member contacts the interference protrusion 94. As the intermediate gear 70 is further driven to rotate from this position, each of the moving members 78 is forced to pivot about the respective pivot shaft 79 while sliding against the interference protrusion 94 until arriving at a position (second position) in which the distal end of the moving member 78 does not protrude from the peripheral surface of the cylindrical part 77. Hence, the moving member 78 is irreversibly shifted (displaced) from the first position to the second position owing to a frictional force between the moving member 78 and the pivot shaft 79 that pivotally supports the moving member 78.

After the moving members 78 are shifted to the second position, the distal ends of the moving members 78 no longer pass through the detection position when the intermediate gear 70 continues to rotate. Hence, the interference protrusion 94 prevents the moving members 78 from passing through the detection position a second time. Therefore, after the CPU 100 recognizes the second reception signal, the actuator 82 no longer pivots as the intermediate gear 70 rotates, and the light-receiving element no longer receives the detection light from the optical sensor 83.

During this idle rotation operation, the CPU 100 determines whether the developer cartridge 28 is a new product based on whether a reception signal is inputted from the optical sensor 83, and determines the maximum number of sheets to be printed with the developer cartridge 28 based on the number of reception signals inputted from the optical sensor 83. More specifically, in the example shown in FIGS. 5 through 11, the CPU 100 determines that the developer cartridge 28 is new upon recognizing the first reception signal, as described above.

Further, the CPU 100 associates the number of inputted reception signals with information regarding the maximum number of sheets to be printed. Specifically, when two reception signals are inputted, for example, the CPU 100 associates this number to a maximum of 6000 sheets to be printed. When a single reception signal is inputted, the CPU 100 associates this number to a maximum 3000 sheets to be printed.

In the example described above for FIGS. 5 through 11, the CPU 100 recognizes the first and second reception signals within a predetermined length of time before the idle rotation operation ends. After recognizing the second reception signal, the CPU 100 determines that the maximum number of sheets to be printed with the new developer cartridge 28 is 6000.

Hence, when the developer cartridge 28 is mounted in the main casing 2 in the examples of FIGS. 5 through 11, the CPU 100 determines that the developer cartridge 28 is new and determines that the maximum number of sheets to be printed with the developer cartridge 28 is 6000. The CPU 100 counts the actual number of printed sheets detected by the paper discharge sensor 64 since the developer cartridge 28 was mounted and displays an out-of-toner warning on a control panel or the like (not shown) when the actual number of printed sheets approaches or reaches 6000.

However, when one of the two moving members 78 (the trailing moving member 78) is omitted from the example in FIGS. 5 through 11 so that the developer cartridge 28 is only provided with one moving member 78 (see FIG. 12), the CPU 100 recognizes only one reception signal when the developer cartridge 28 is mounted. Accordingly, the CPU 100 determines that the developer cartridge 28 is new and that the maximum number of sheets to be printed with the developer cartridge 28 is 3000. The CPU 100 counts the actual number of printed sheets detected by the paper discharge sensor 64 since the developer cartridge 28 was mounted and displays an out-of-toner warning on a control panel or the like (not shown) when the actual number of printed sheets approaches or reaches 3000.

However, if a new developer cartridge 28 mounted in the main casing 2 is later removed temporarily and subsequently remounted, the CPU 100 initiates the warm-up operation in which the idle rotation operation is executed to rotate the agitator 36. At this time, the moving member 78 does not pass the detection position, as described above, and the optical sensor 83 does not input a reception signal into the CPU 100. Therefore, the CPU 100 determines that the developer cartridge 28 is old, since no reception signals were recognized during the idle rotation operation.

Here, the developer cartridge 28 according to the invention is not limited to a structure having either one or two moving members 78, but may be configured with three or more moving members 78. In such a case, the CPU 100 can determine information on the developer cartridge 28 corresponding to the number of moving members 78.

<Effects of the Method for Detecting a New Developer Cartridge According to the Illustrative Aspects>

With the laser printer 1 described above, the motor 59 drives the intermediate gear 70 when the developer cartridge 28 is mounted in the main casing 2. While the intermediate gear 70 is driven, the moving member 78 moves and passes the detection position. The information-detecting mechanism 81 detects this passage of the moving member 78. The CPU 100 determines information concerning the developer cartridge 28 (whether the developer cartridge 28 is new and, if new, the maximum number of sheets to be printed with the developer cartridge 28) based on detection results by the information-detecting mechanism 81 (whether a reception signal was inputted and the number of inputted reception signals). Therefore, a laser printer 1 capable of determining information on a developer cartridge 28 can be produced with reduced manufacturing costs through a simple construction provided with a single information-detecting mechanism 81.

After the information-detecting mechanism 81 detects passage of the moving member 78, the interference protrusion 94 interferes with the moving member 78 to prevent the moving member 78 from passing the detection position thereafter. Accordingly, the laser printer 1 according to the illustrative aspects can easily and reliably determine whether the developer cartridge 28 is new based on whether the information-detecting mechanism 81 detects passage of the moving member 78 when the developer cartridge 28 is mounted in the main casing 2 and the intermediate gear 70 is driven by the motor 59. Hence, the laser printer 1 can determine the life of the developer cartridge 28 from the point that the developer cartridge 28 was determined to be new.

Since the information-detecting mechanism 81 allows passage of the moving member 78 while detecting this passage, it is possible to provide a plurality of moving members 78 and to have a plurality of moving members 78 pass the detection position. As a result, the CPU 100 can determine information for a plurality of the developer cartridges 28 based on the number of moving members 78 that the information-detecting mechanism 81 detects. If the information concerning the developer cartridge 28 includes the maximum number of sheets to be printed based on the amount of toner accommodated in the developer cartridge 28, it is possible to accurately determine the life of the developer cartridge 28 mounted in the main casing 2 and to properly replace the developer cartridge 28, even when using developer cartridges 28 having different amounts of toner.

After the information-detecting mechanism 81 detects passage of the moving member 78 in the first position, the interference protrusion 94 interferes with the moving member 78 and irreversibly shifts (pivots) the moving member 78 to the second position, thereby preventing the information-detecting mechanism 81 from detecting passage of the moving member 78 thereafter. Hence, a laser printer 1 capable of determining information concerning the developer cartridge 28 can be produced with reduced manufacturing costs through a simple structure including moving members 78 that are irreversibly shifted from the first position to the second position.

By disposing the moving members 78 on the intermediate gear 70 provided in the developer cartridge 28, it is not necessary to provide a new drive member for transferring the driving force of the motor 59 to the moving member 78. Therefore, it is possible to produce a more compact device, while avoiding a rise in manufacturing costs and structural complexity.

Disposing the moving members 78 on the intermediate gear 70, which can be positioned with more freedom than the input gear 67 and agitator drive gear 71, facilitates placement of the moving members 78 in positions that can easily be detected by the information-detecting mechanism 81.

Further, the contact position between the moving members 78 provided on the intermediate gear 70 and the interference protrusion 94 can be determined by disposing the interference protrusion 94 on the gear cover 66 and covering the intermediate gear 70 with the gear cover 66. This structure ensures that the interference protrusion 94 can reliably interfere with the moving members 78.

Since the moving members 78, in the first position, are disposed to extend along the radial directions of the intermediate gear support shaft 74, it is possible to prevent the developer cartridge 28 from becoming larger in the widthwise direction, enabling the developer cartridge 28 to be made more compact.

Although the moving members 78 contact the contact pawl 86 of the actuator 82, the moving members 78 are able to pass the detection position and subsequently contact the interference protrusion 94, without being hindered by the contact pawl 86. Hence, the information-detecting mechanism 81 can reliably detect passage of the moving members 78.

<Structure for Detecting a New Developer Cartridge According to Additional Aspects>

Figure 13:
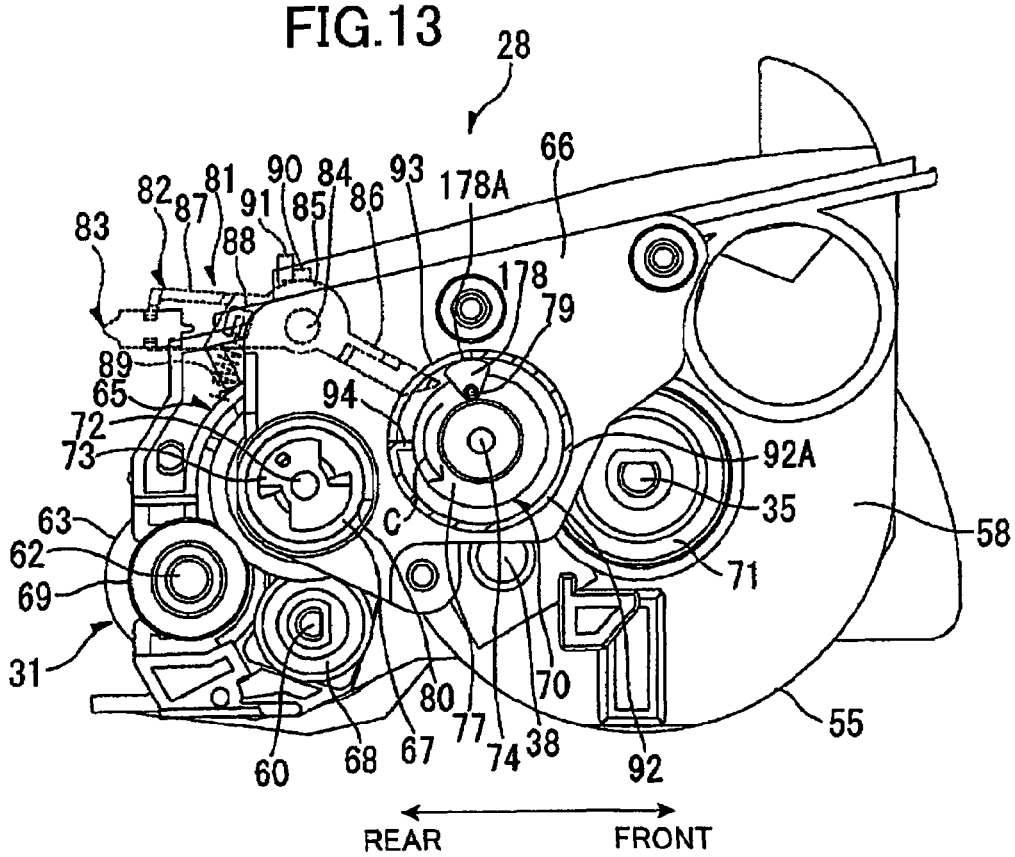
FIG. 13 is a side cross-sectional view of a developer cartridge (with a gear cover mounted) according to additional aspects, when a gear cover is mounted in a main casing.
Figure 14:
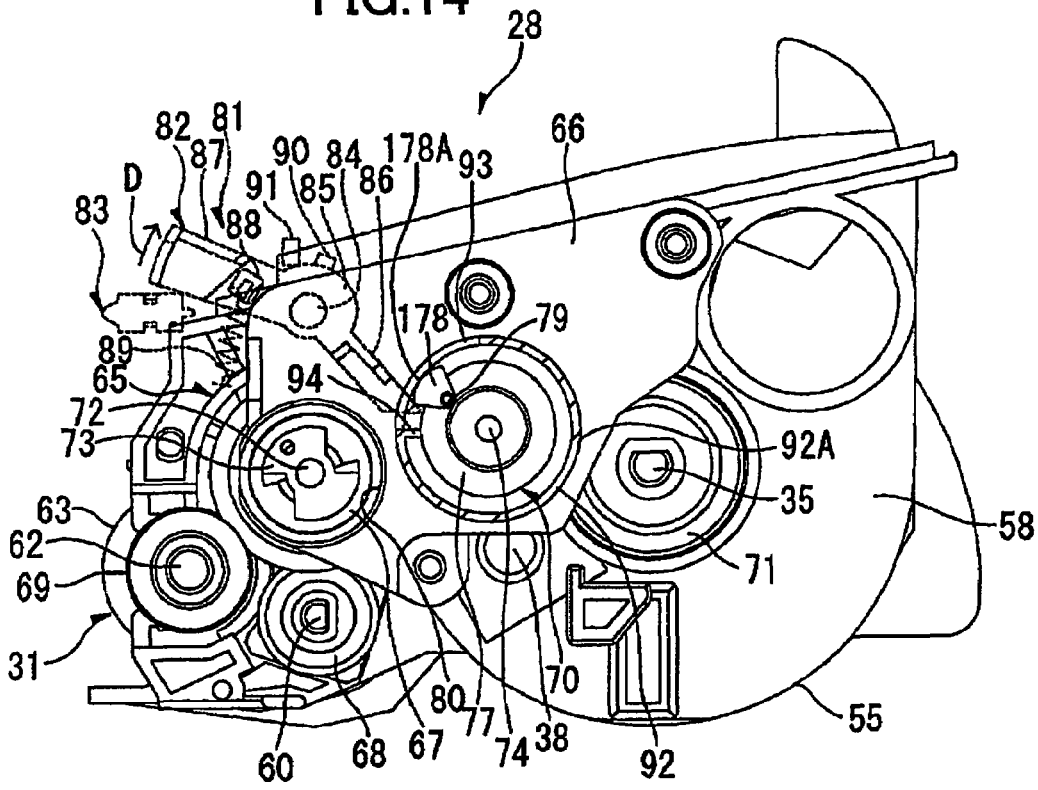
FIG. 14 is a side cross-sectional view of a developer cartridge (with a gear cover mounted) according to additional aspects, when a moving member is in contact with an actuator.
Figure 15:
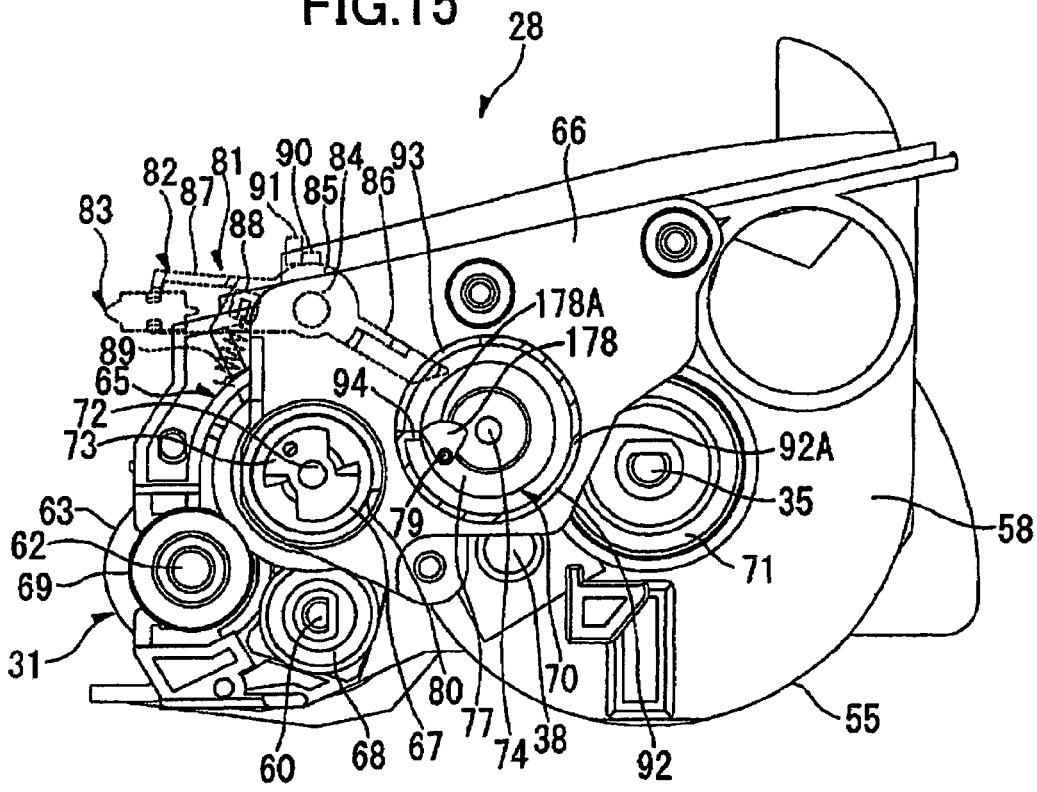
FIG. 15 is a side cross-sectional view of a developer cartridge (with the gear cover mounted) according to additional aspects, when the moving member has contacted an interference protrusion and pivotally moved.

FIGS. 13 through 15 are side cross-sectional views of a developer cartridge according to additional aspects of the invention, when a gear cover is mounted thereon, wherein like parts and components are designated with the same reference numerals to avoid duplicating description.

As shown in FIG. 13, the developer cartridge 28 according to the additional aspects has a moving member 178. Unlike the moving member 78 of the illustrative aspects that is substantially rod-shaped, the moving member 178 according to the additional aspects is substantially fan-shaped (or, shaped like a circular sector) and has an arcing peripheral surface 178A. The developer cartridge 28 includes a single moving member 178 that is attached to an end face of the cylindrical part 77 on the side opposite the outer teeth 75. The moving member 178 has a base end at the side that forms a central angle to the arcing peripheral surface 178A. The moving member 178 is pivotally supported at the base end on the pivot shaft 79 that protrudes laterally outward from the end face of the cylindrical part 77 opposite the side of the outer teeth 75. The distal end of the moving member 178 on which the arcing peripheral surface 178A is formed extends radially outward with respect to the intermediate gear support shaft 74.

The circumferential length of the arcing peripheral surface 178A serves as information on the developer cartridge 28 relating to the amount of toner accommodated in the toner-accommodating chamber 34 when the developer cartridge 28 is new. Specifically, the arcing peripheral surface 178A corresponds to information on the maximum number of sheets 3 on which images can be formed with the amount of toner accommodated in the toner-accommodating chamber 34 (maximum number of sheets to be printed).

Figure 12:
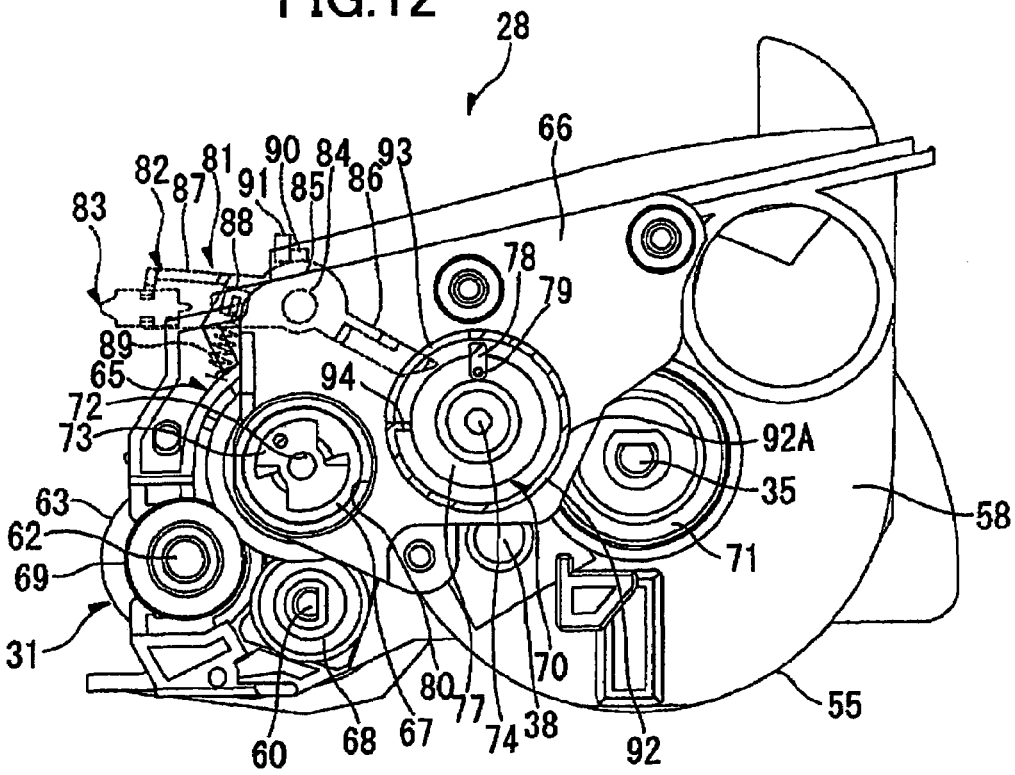
FIG. 12 is a side cross-sectional view of the developer cartridge (with the gear cover mounted) according to the illustrative aspects when the developer cartridge is mounted in the main casing, where the rear moving member has been omitted.

More specifically, if the moving member 78 is substantially rod-shaped as in FIG. 12, this shape corresponds to information indicating that the maximum number of sheets to be printed is 3000. However, if the moving member 178 is substantially fan-shaped as in FIG. 13, this shape corresponds to information indicating that the maximum number of sheets to be printed is 6000.

<Operations for Detecting a New Developer Cartridge According to the Additional Aspects>

Next, a method will be described for determining whether a developer cartridge 28 according to the additional aspects mounted in the main casing is new or old and for determining the maximum number of sheets to be printed by the developer cartridge 28.

In this method, the front cover 2B is first opened, and the process cartridge 17 on which the new developer cartridge 28 is mounted is inserted into the main casing 2 through the access opening 2A. Alternatively, the front cover 2B is opened and the new developer cartridge 28 is inserted through the access opening 2A and mounted on the process cartridge 17 already mounted in the main casing 2.

As shown in FIG. 13, a single substantially fan-shaped (or, shaped like a circular sector) moving member 178 is provided on the intermediate gear 70 in the developer cartridge 28. When the developer cartridge 28 is new, the moving member 178 is disposed to extend in a radial direction of the intermediate gear support shaft 74 (first position), as shown in FIG. 13. Also, the moving member 178 is positioned upstream of the detection position. Accordingly, the moving member 178 does not contact the contact pawl 86 of the actuator 82 when the developer cartridge 28 is mounted in the main casing 2, and the actuator 82 is maintained in its normal state with the light-blocking part 87 blocking the detection light of the optical sensor 83.

After the developer cartridge 28 is mounted in the main casing 2, the CPU 100 initiates a warm-up operation in which an idle rotation operation is executed to rotate the agitator 36. During this operation, the intermediate gear 70 is driven to rotate along with the driving of the motor 59, causing the moving member 178 mounted on the cylindrical part 77 to move in a circumferential direction C (counterclockwise in FIG. 13). At this time, as shown in FIG. 14, the distal end of the moving member 178 contacts the contact pawl 86 of the actuator 82 at the detection position in a downward motion. The actuator 82 pivots around the cylindrical insertion part 85 against the urging force of the tension spring 89 so that the contact pawl 86 moves downward and the light-blocking part 87 moves upward, as indicated by the arrow D in FIG. 14. Hence, the light-receiving element receives the detection light from the optical sensor 83, which detection light was previously blocked by the light-blocking part 87 when the actuator 82 was in its normal state. The optical sensor 83 transmits a reception signal based on the received light to the CPU 100. The CPU 100 recognizes the reception signal as the first reception signal and resets the number of printed sheets that is detected by the paper discharge sensor 64.

As the intermediate gear 70 is further driven to rotate, the arcing peripheral surface 178A of the moving member 178 further presses the contact pawl 86 while sliding along the contact pawl 86 and subsequently passes and separates from the contact pawl 86. Accordingly, when contact between the moving member 178 and contact pawl 86 is removed, the urging force of the tension spring 89 causes the actuator 82 to pivot about the cylindrical insertion part 85 in the opposite direction of the arrow D in FIG. 14 so that the contact pawl 86 moves upward and the light-blocking part 87 moves downward until the actuator 82 returns to its normal state. At this time, the light-blocking part 87 once again blocks the detection light of the optical sensor 83 that had been received by the light-receiving element.

As in the illustrative aspects, after the moving member 178 passes the detection position, the distal end of the moving member 178 contacts the interference protrusion 94. As the intermediate gear 70 is further driven to rotate from this position, the moving member 178 is forced to pivot about the pivot shaft 79 while sliding against the interference protrusion 94 until arriving at a position (second position) in which the arcing peripheral surface 178A of the moving member 178 does not protrude from the peripheral surface of the cylindrical part 77, as shown in FIG. 15. Hence, the moving member 178 is irreversibly shifted (displaced) from the first position to the second position owing to a frictional force between the moving member 178 and the pivot shaft 79 that pivotally supports the moving member 178.

As in the illustrative aspects, after the moving member 178 is shifted to the second position, the distal end of the moving member 178 no longer passes through the detection position when the intermediate gear 70 continues to rotate. Hence, the interference protrusion 94 prevents the moving member 178 from passing through the detection position a second time. Therefore, after the CPU 100 recognizes the first reception signal, the actuator 82 no longer pivots as the intermediate gear 70 rotates, and the light-receiving element no longer receives the detection light from the optical sensor 83.

During this idle rotation operation, the CPU 100 determines whether the developer cartridge 28 is a new product based on whether a reception signal is inputted from the optical sensor 83, and determines the maximum number of sheets to be printed with the developer cartridge 28 based on the number of reception signals inputted from the optical sensor 83.

Specifically, in the idle rotation operation of the additional aspects shown in FIGS. 13 through 15, the moving member 178 contacts the contact pawl 86, as shown in FIG. 14, and subsequently slides along the contact pawl 86 while passing the detection position. Being substantially fan-shaped, the moving member 178 requires a longer time to pass the contact pawl 86. Hence, the optical sensor 83 inputs a reception signal into the CPU 100 over a period corresponding to this longer time.

However, since the moving member 78 in FIG. 12 is substantially rod-shaped, after first contacting the contact pawl 86 in the idle rotation operation, the moving member 78 requires a shorter time to slide past the contact pawl 86. Hence, the optical sensor 83 inputs a reception signal into the CPU 100 over a shorter length of time.

In this way, the CPU 100 can determine the maximum number of sheets to be printed with the developer cartridge 28 based on the input time of the reception signal. For example, the CPU 100 can determine that the maximum number of sheets to be printed is 3000 when the input time is short and that the maximum number of sheets to be printed is 6000 when the input time is long.

Hence, when the developer cartridge 28 is mounted in the examples of FIGS. 13 through 15, the CPU 100 determines that the developer cartridge 28 is new and determines that the maximum number of sheets to be printed with the developer cartridge 28 is 6000. The CPU 100 counts the actual number of printed sheets detected by the paper discharge sensor 64 since the developer cartridge 28 was mounted and displays an out-of-toner warning on a control panel or the like (not shown) when the actual number of printed sheets approaches or reaches 6000.

However, if a new developer cartridge 28 mounted in the main casing 2 is later removed temporarily and subsequently remounted, the CPU 100 initiates the warm-up operation in which the idle rotation operation is executed to rotate the agitator 36. At this time, the moving member 178 does not pass the detection position, as described above, and the optical sensor 83 does not input a reception signal into the CPU 100. Therefore, the CPU 100 determines that the developer cartridge 28 was old, since no reception signals were recognized during the idle rotation operation.

Here, the developer cartridge 28 according to the invention is not limited to a structure having one moving member 178, but may be configured with two or more moving members 178.

<Effects of the Method for Detecting a New Developer Cartridge According to the Additional Aspects>

With the laser printer 1 described above, the motor 59 drives the intermediate gear 70 when the developer cartridge 28 is mounted in the main casing 2. While the intermediate gear 70 is driven, the moving member 178 moves and passes the detection position. The information-detecting mechanism 81 detects this passage of the moving member 178. The CPU 100 determines information concerning the developer cartridge 28 (whether the developer cartridge 28 is new and, if new, the maximum number of sheets to be printed with the developer cartridge 28) based on detection results by the information-detecting mechanism 81 (whether a reception signal was inputted and the length of time of inputted reception signals). Therefore, a laser printer 1 capable of determining information on a developer cartridge 28 can be produced with reduced manufacturing costs through a simple construction provided with a single information-detecting mechanism 81.

After the information-detecting mechanism 81 detects passage of the moving member 178, the interference protrusion 94 interferes with the moving member 178 to prevent the moving member 178 from passing the detection position thereafter. Accordingly, the laser printer 1 according to the additional aspects can easily and reliably determine whether the developer cartridge 28 is new based on whether the information-detecting mechanism 81 detects passage of the moving member 178 when the developer cartridge 28 is mounted in the main casing 2 and the intermediate gear 70 is driven by the motor 59. Hence, the laser printer 1 can determine the life of the developer cartridge 28 from the point that the developer cartridge 28 was determined to be new.

Further, by setting the peripheral length of the arcing peripheral surface 178A on the fan-shaped (circular sector-shaped) moving member 178 to correspond to information on the developer cartridge 28 (maximum number of sheets to be printed), the CPU 100 can determine information for a plurality of developer cartridges 28 corresponding to these peripheral lengths based on the length of time that the information-detecting mechanism 81 detects the moving member 178.

After the information-detecting mechanism 81 detects passage of the moving member 178 in the first position, the interference protrusion 94 interferes with the moving member 178 and irreversibly shifts (pivots) the moving member 178 to the second position, thereby preventing the information-detecting mechanism 81 from detecting passage of the moving member 178 thereafter. Hence, a laser printer 1 capable of determining information concerning the developer cartridge 28 can be produced with reduced manufacturing costs through a simple structure including the moving member 178 that is irreversibly shifted from the first position to the second position.

By disposing the moving member 178 on the intermediate gear 70 provided in the developer cartridge 28, it is not necessary to provide a new drive member for transferring the driving force of the motor 59 to the moving member 178. Therefore, it is possible to produce a more compact device, while avoiding a rise in manufacturing costs and structural complexity.

Disposing the moving member 178 on the intermediate gear 70, which can be positioned with more freedom than the input gear 67 and agitator drive gear 71, facilitates placement of the moving member 178 in a position that can easily be detected by the information-detecting mechanism 81.

Further, the contact position between the moving member 178 provided on the intermediate gear 70 and the interference protrusion 94 can be determined by disposing the interference protrusion 94 on the gear cover 66 and covering the intermediate gear 70 with the gear cover 66. This structure ensures that the interference protrusion 94 can reliably interfere with the moving member 178.

Since the moving member 178 is disposed to extend along a radial direction of the intermediate gear support shaft 74, it is possible to prevent the developer cartridge 28 from becoming larger in the widthwise direction, enabling the developer cartridge 28 to be made more compact.

Although the moving member 178 contacts the contact pawl 86 of the actuator 82, the moving member 178 is able to pass the detection position and subsequently contact the interference protrusion 94, without being hindered by the contact pawl 86. Hence, the information-detecting mechanism 81 can reliably detect passage of the moving member 178.

<Structure for Detecting a New Developer Cartridge According to Further Additional Aspects>

Figure 16:
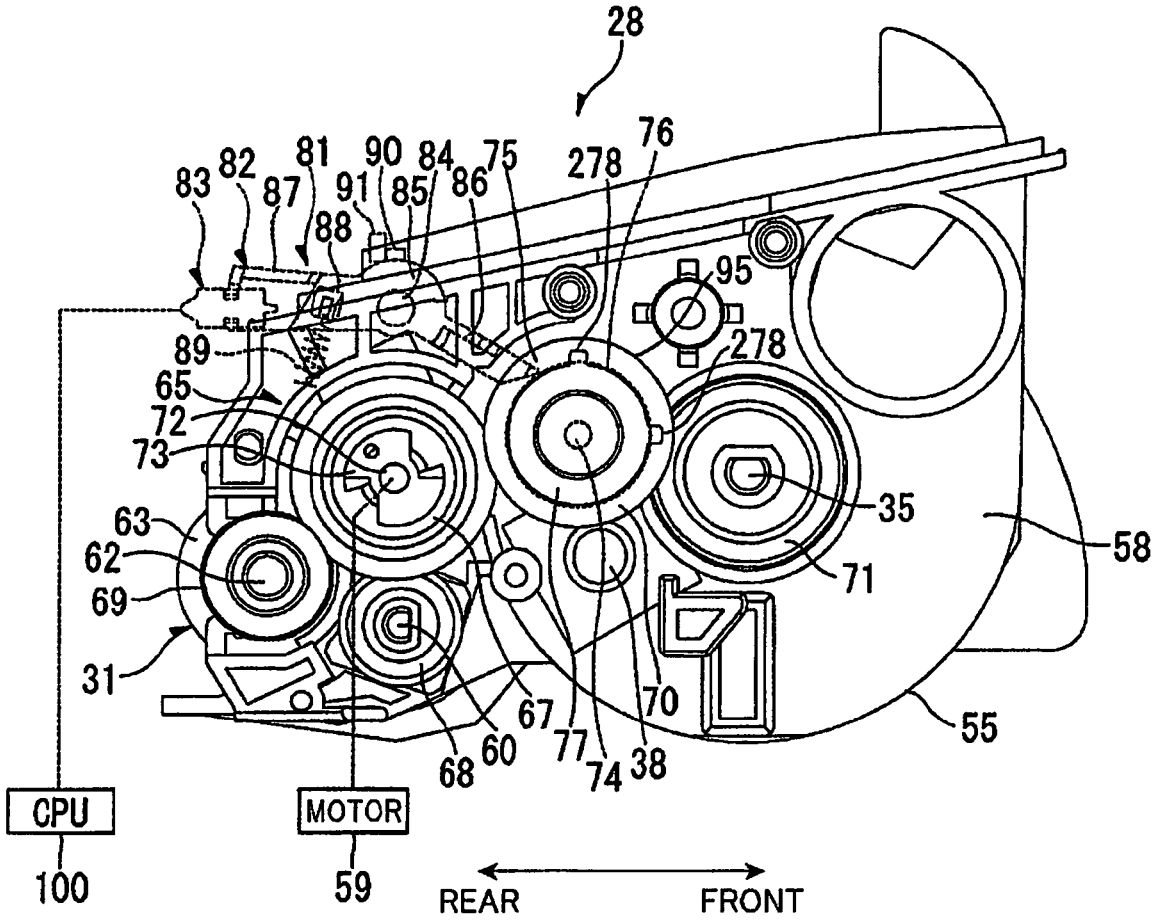
FIG. 16 is a side view of a developer cartridge according to further additional aspects, when a gear cover has been removed.
Figure 17:
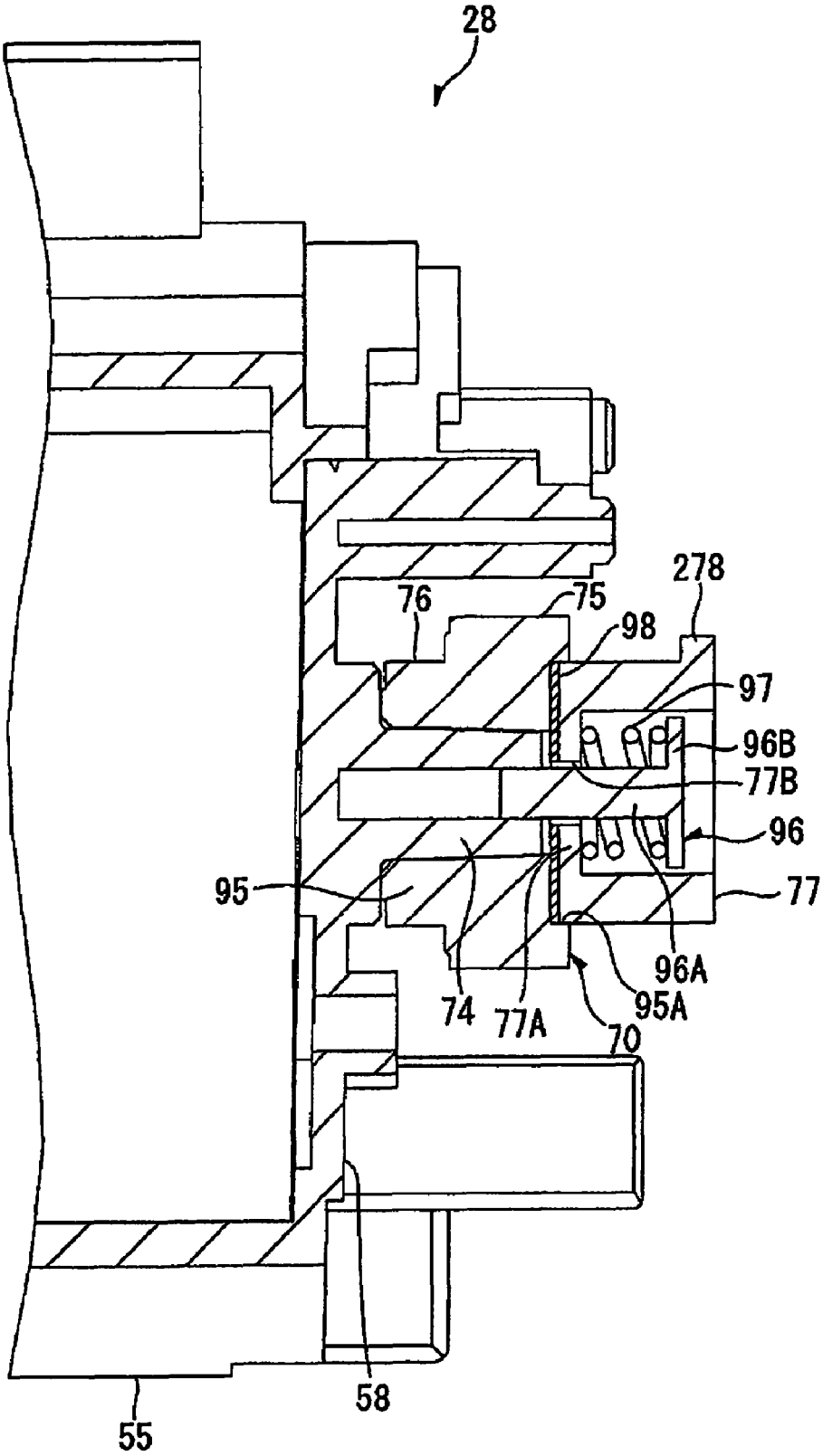
FIG. 17 is a cross-sectional view of the developer cartridge according to the further additional aspects, when the gear cover has been removed.
Figure 18:
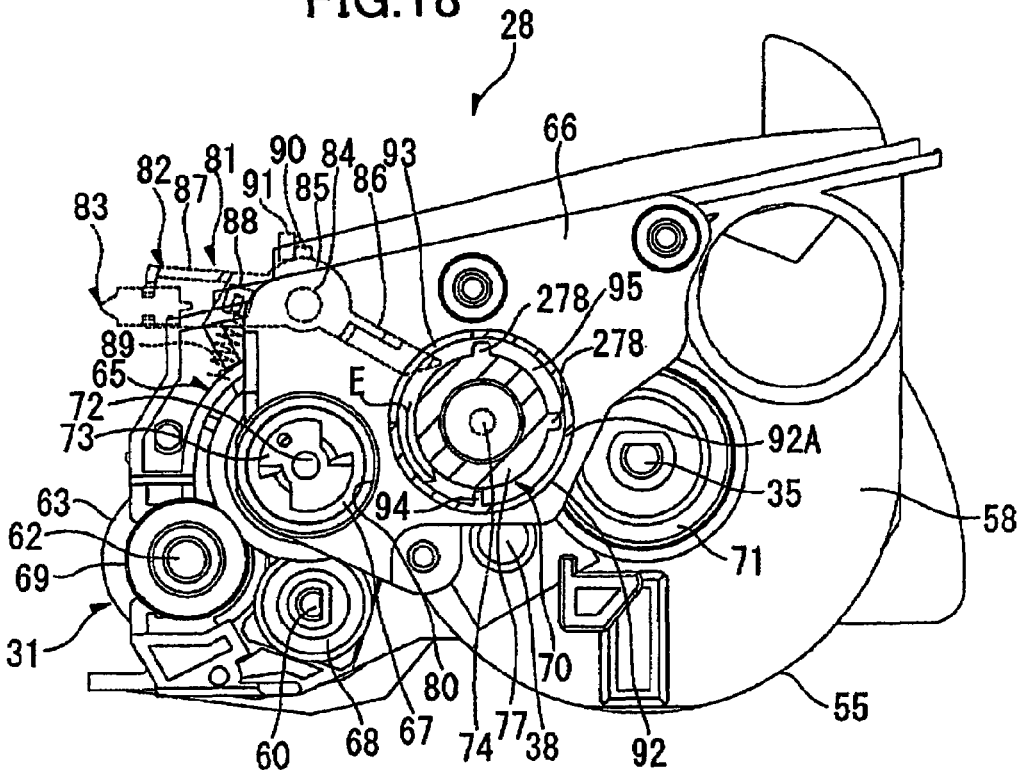
FIG. 18 is a side cross-sectional view of the developer cartridge (with the gear cover mounted) according to the further additional aspects illustrating a mechanism for detecting a new product, when the developer cartridge is mounted in a main casing.
Figure 19:
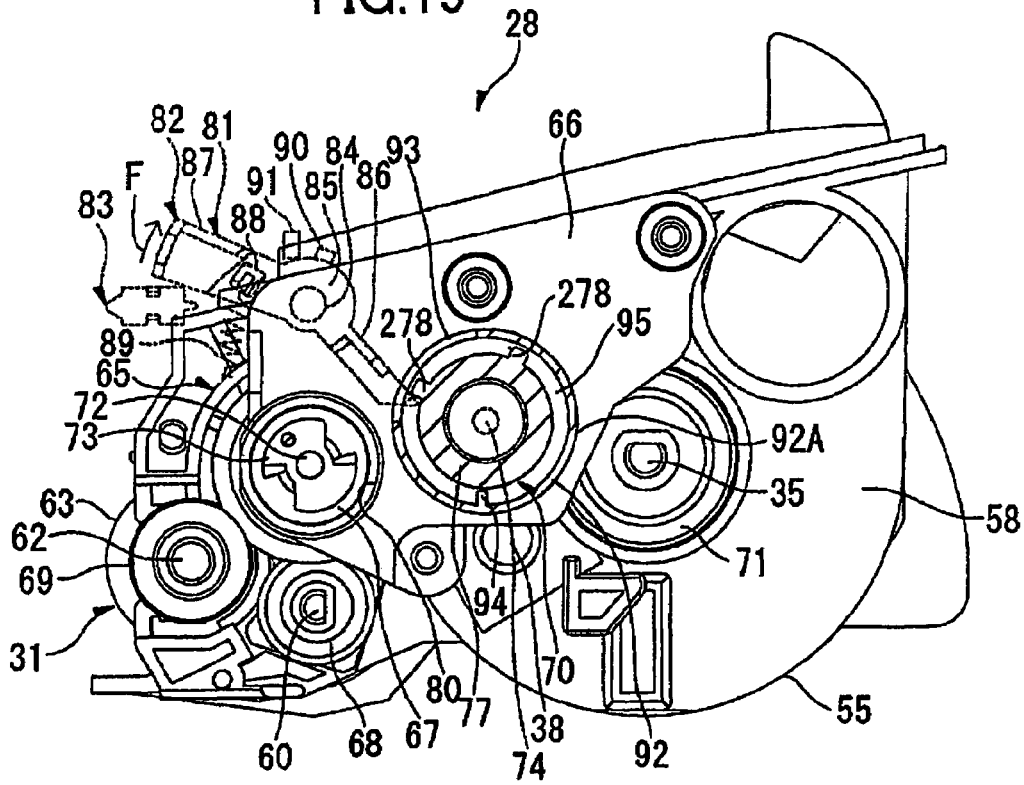
FIG. 19 is a side cross-sectional view of the developer cartridge (with the gear cover mounted) according to the further additional aspects illustrating the mechanism for detecting a new product, when a front moving member is in contact with an actuator.
Figure 20:
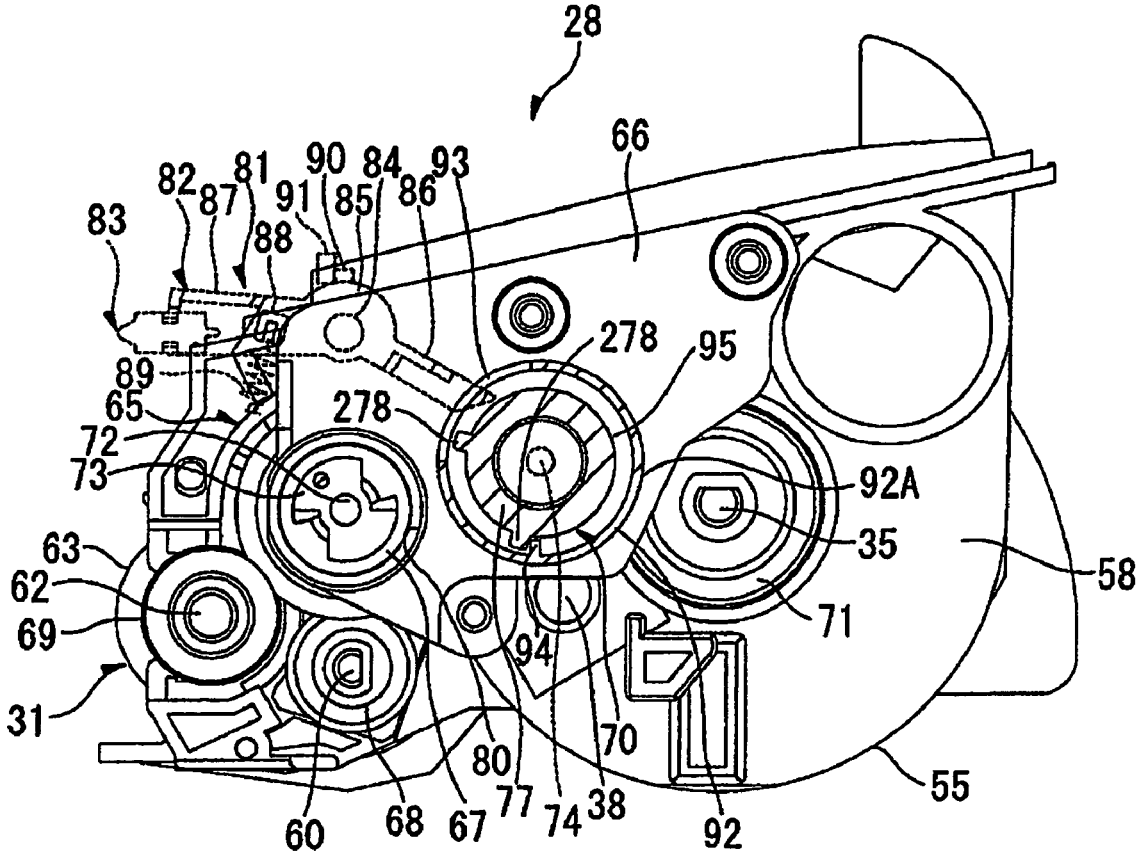
FIG. 20 is a side cross-sectional view of the developer cartridge (with the gear cover mounted) according to the further additional aspects illustrating the mechanism for detecting a new product, when the front moving member is in contact with an interference protrusion.

FIG. 16 is a side view of a developer cartridge according to further additional aspects in which the gear cover has been removed. FIG. 17 is a cross-sectional view of the developer cartridge according to the further additional aspects in which the gear cover has been removed. FIGS. 18 through 20 are side cross-sectional views of the developer cartridge according to the further additional aspects in which the gear cover is mounted and illustrates the structure for detecting a new developer cartridge. In the developer cartridge according to the further additional aspects, like numbers and components to the developer cartridge according to the illustrative aspects described above are designated with the same reference numerals to avoid duplicating description.

As shown in FIGS. 16 and 17, moving members 278 are not pivotally supported, not like the moving members 78 in the illustrative aspects, but are formed as substantial protrusions protruding from the outer surface of the cylindrical part 77. The developer cartridge 28 according is to the further additional aspects is provided with two of the moving members 278 that protrude in radial directions of the intermediate gear support shaft 74 from the peripheral surface of the cylindrical part 77 on the edge opposite the outer teeth 75. Each moving member 278 has a base end fixed to the peripheral surface of the cylindrical part 77, and a distal end extending outward in a radial direction of the intermediate gear support shaft 74. The base parts of the moving members 278 are disposed at intervals along the peripheral surface of the cylindrical part 77 so as to form an angle of about 90° with the intermediate gear support shaft 74 as the vertex.

A main intermediate gear body 95 is integrally provided with the outer teeth 75 and inner teeth 76. The cylindrical part 77 of the intermediate gear 70 is rotatably attached to the main intermediate gear body 95 via a fixing piece 96 (FIG. 17) and is coaxial with the intermediate gear support shaft 74. An end face wall 77A closes off the end face of the cylindrical part 77 on the side of the main intermediate gear body 95. A recessed part 95A substantially circular in shape and corresponding to the peripheral surface of the cylindrical part 77 is formed in an end face of the main intermediate gear body 95 on the side of the cylindrical part 77. The end face wall 77A side of the cylindrical part 77 is fitted into the recessed part 95A. A through-hole 77B is formed through the thickness of the end face wall 77A in the center region thereof.

The fixing piece 96 includes a shaft part 96A and a head part 96B formed on an end of the shaft part 96A and having an area in a cross-section orthogonal to the axial direction greater than the shaft part 96A. The shaft part 96A of the fixing piece 96 is inserted through the through-hole 77B formed in the end face wall 77A and fixedly inserted into the intermediate gear support shaft 74. With this construction, the fixing piece 96 is disposed inside the cylindrical part 77 and laterally outside of the intermediate gear support shaft 74. When the fixing piece 96 is fixed, a gap is formed between the head part 96B and the end face wall 77A. A compressed spring 97 is provided in this gap around the shaft part 96A of the fixing piece 96. One end of the compressed spring 97 contacts the end face wall 77A of the cylindrical part 77, while the other end contacts the head part 96B of the fixing piece 96 so that the compressed spring 97 is compressed to a degree.

A frictional member 98 formed of felt is attached to the surface of the end face wall 77A opposing the main intermediate gear body 95. The urging force of the compressed spring 97 presses the cylindrical part 77 toward the main intermediate gear body 95, and the cylindrical part 77 is coupled with the main intermediate gear body 95 by a frictional force produced between the recessed part 95A and the frictional member 98. More specifically, the cylindrical part 77 of the intermediate gear 70 is coupled to the main intermediate gear body 95 via the frictional member 98 by a frictional force that prevents the cylindrical part 77 from moving relative to the main intermediate gear body 95 when the interference protrusion 94 is not interfering with the moving members 278 and that allows the cylindrical part 77 to move relative to the main intermediate gear body 95 when the interference protrusion 94 interferes with the moving member 278, as will be described later. With this construction, the cylindrical part 77, which is formed integrally with the moving members 278, acts as a coupling member for coupling the moving members 278 with the main intermediate gear body 95.

The number of moving members 278 corresponds to information on the developer cartridge 28 relating to the amount of toner accommodated in the toner-accommodating chamber 34 when the developer cartridge 28 is new. In other words, the number of moving members 278 corresponds to information on the maximum number of sheets 3 on which images can be formed with the amount of toner accommodated in the toner-accommodating chamber 34 (hereinafter referred to as the maximum number of sheets to be printed).

More specifically, when two moving members 278 are provided, as in the example of FIG. 16, the number of moving members 278 corresponds to information indicating that the maximum number of sheets to be printed is 6000. When only one moving member 278 is provided, the number of moving members 278 corresponds to information indicating that the maximum number of sheets to be printed is 3000.

In the further additional aspects, the interference protrusion 94 provided on the intermediate gear cover 92 of the gear cover 66 is disposed downstream of the detection position with respect to the direction that the moving members 278 move, and protrudes radially inward from the lowermost part on the inner peripheral surface of the peripheral wall 92A (see FIG. 18).

<Operations for Detecting a New Developer Cartridge According to the Further Additional Aspects>

Next, a method will be described for determining whether a developer cartridge 28 according to the further additional aspects mounted in the main casing is new or old and for determining the maximum number of sheets to be printed by the developer cartridge 28.

In this method, the front cover 2B is first opened, and the process cartridge 17 on which the new developer cartridge 28 is mounted is inserted into the main casing 2 through the access opening 2A. Alternatively, the front cover 2B is opened and the new developer cartridge 28 is inserted through the access opening 2A and mounted on the process cartridge 17 already mounted in the main casing 2.

As shown in FIG. 18, two of the moving members 278 are provided on the intermediate gear 70 in the developer cartridge 28. When the developer cartridge 28 is new, the moving members 278 are positioned upstream of the detection position, as shown in FIG. 18. Accordingly, the moving members 278 do not contact the contact pawl 86 of the actuator 82 when the developer cartridge 28 is mounted in the main casing 2, and the actuator 82 is maintained in its normal state with the light-blocking part 87 blocking the detection light of the optical sensor 83.

After the developer cartridge 28 is mounted in the main casing 2, the CPU 100 initiates a warm-up operation in which an idle rotation operation is executed to rotate the agitator 36. During this operation, the intermediate gear 70 is driven to rotate along with the driving of the motor 59, causing the moving members 278 formed on the cylindrical part 77 to move in a circumferential direction E (counterclockwise in FIG. 18). At this time, as shown in FIG. 19, the distal end of the leading-(front) moving member 278 contacts the contact pawl 86 of the actuator 82 at the detection position in a downward motion. The actuator 82 pivots around the cylindrical insertion part 85 against the urging force of the tension spring 89 so that the contact pawl 86 moves downward and the light-blocking part 87 moves upward, as indicated by the arrow F. Hence, the light-receiving element receives the detection light from the optical sensor 83, which detection light was previously blocked by the light-blocking part 87 when the actuator 82 was in its normal state. The optical sensor 83 transmits a reception signal based on the received light to the CPU 100. The CPU 100 recognizes the reception signal as the first reception signal and resets the number of printed sheets that is detected by the paper discharge sensor 64.

As the intermediate gear 70 is further driven to rotate, the distal end of the leading (front) moving member 278 further presses the contact pawl 86 while sliding along the contact pawl 86 and subsequently passes and separates from the contact pawl 86. Accordingly, when contact between the moving member 278 and contact pawl 86 is removed, the urging force of the tension spring 89 causes the actuator 82 to pivot about the cylindrical insertion part 85 in the opposite direction of the arrow F in FIG. 19 so that the contact pawl 86 moves upward and the light-blocking part 87 moves downward until the actuator 82 returns to its normal state. At this time, the light-blocking part 87 once again blocks the detection light of the optical sensor 83 that had been received by the light-receiving element.

Similarly, when the intermediate gear 70 is further driven to rotate, the distal end of the trailing (rear) moving member 278 contacts the contact pawl 86 of the actuator 82 at the detection position in a downward motion. The actuator 82 pivots around the cylindrical insertion part 85 against the urging force of the tension spring 89 so that the contact pawl 86 moves downward and the light-blocking part 87 moves upward, as indicated by the arrow F in FIG. 19. Hence, the light-receiving element receives the detection light from the optical sensor 83, which detection light was previously blocked by the light-blocking part 87 when the actuator 82 was in its normal state. The optical sensor 83 transmits a reception signal based on the received light to the CPU 100. The CPU 100 recognizes the reception signal as the second reception signal.

As the intermediate gear 70 is further driven to rotate, the distal end of the trailing (rear) moving member 278 further presses the contact pawl-86 while sliding along the contact pawl 86 and subsequently passes and separates from the contact pawl 86. Accordingly, when contact between the moving member 278 and contact pawl 86 is removed, the urging force of the tension spring 89 causes the actuator 82 to pivot about the cylindrical insertion part 85 in the opposite direction of the arrow F in FIG. 19 so that the contact pawl 86 moves upward and the light-blocking part 87 moves downward until the actuator 82 returns to its normal state. At this time, the light-blocking part 87 once again blocks the detection light of the optical sensor 83 that had been received by the light-receiving element.

As shown in FIG. 20, when the intermediate gear 70 subsequently rotates further, a distal end of the leading (front) moving member 278 contacts the interference protrusion 94 protruding from the lowermost part of the peripheral wall 92A on the inner peripheral surface thereof. After the distal end of the leading moving member 278 contacts the interference protrusion 94, the cylindrical part 77 is capable of sliding relative to the main intermediate gear body 95, and the main intermediate gear body 95 rotates idly relative to the cylindrical part 77. Hence, the moving members 278 are released (or prevented) from moving together with the main intermediate gear body 95. Accordingly, the moving member 278 is maintained in contact with the interference protrusion 94, even as the main intermediate gear body 95 continues to rotate, so that the distal ends of the moving members 278 do not pass by the detection position thereafter. Hence, the interference protrusion 94 prevents the moving members 278 from passing through the detection position a second time. Therefore, after the CPU 100 recognizes the second reception signal, the actuator 82 no longer pivots as the intermediate gear 70 rotates, and the light-receiving element no longer receives the detection light from the optical sensor 83.

During this idle rotation operation, the CPU 100 determines whether the developer cartridge 28 is a new product based on whether a reception signal is inputted from the optical sensor 83, and determines the maximum number of sheets to be printed with the developer cartridge 28 based on the number of reception signals inputted from the optical sensor 83.

More specifically, in the example shown in FIGS. 18 through 20, the CPU 100 determines that the developer cartridge 28 is new upon recognizing the first reception signal, as described above.

Further, the CPU 100 associates the number of inputted reception signals with information regarding the maximum number of sheets to be printed. Specifically, when two reception signals are inputted, for example, the CPU 100 associates this number to a maximum of 6000 sheets to be printed. When a single reception signal is inputted, the CPU 100 associates this number to a maximum 3000 sheets to be printed.

In the example described above for FIGS. 18 through 20, the CPU 100 recognizes the first and second reception signals within a predetermined length of time before the idle rotation operation ends. After recognizing the second reception signal, the CPU 100 determines that the maximum number of sheets to be printed with the new developer cartridge 28 is 6000.

Hence, when the developer cartridge 28 is mounted in the examples of FIGS. 18 through 20, the CPU 100 determines that the developer cartridge 28 is new and determines that the maximum number of sheets to be printed with the developer cartridge 28 is 6000. The CPU 100 counts the actual number of printed sheets detected by the paper discharge sensor 64 since the developer cartridge 28 was mounted and displays an out-of-toner warning on a control panel or the like (not shown) when the actual number of printed sheets approaches or reaches 6000.

When one of the two moving members 278 (the trailing moving member 278) is omitted from the example in FIGS. 18 through 20 so that the developer cartridge 28 is only provided with one moving member 278, the CPU 100 recognizes only one reception signal when the developer cartridge 28 is mounted. Accordingly, the CPU 100 determines that the developer cartridge 28 is new and that the maximum number of sheets to be printed with the developer cartridge 28 is 3000. The CPU 100 counts the actual number of printed sheets detected by the paper discharge sensor 64 since the developer cartridge 28 was mounted and displays an out-of-toner warning on a control panel or the like (not shown) when the actual number of printed sheets approaches or reaches 3000.

However, if a new developer cartridge 28 mounted in the main casing 2 is later removed temporarily and subsequently remounted, the CPU 100 initiates the warm-up operation in which the idle rotation operation is executed to rotate the agitator 36. At this time, the moving member 278 does not pass the detection position, as described above, and the optical sensor 83 does not input a reception signal into the CPU 100. Therefore, the CPU 100 determines that the developer cartridge 28 is old, since no reception signals were recognized during the idle rotation operation.

Here, the developer cartridge 28 according to the invention is not limited to a structure having either one or two moving members 278, but may be configured with three or more moving members 278. In such a case, the CPU 100 can determine information on the developer cartridge 28 corresponding to the number of moving members 278.

<Effects of the Method for Detecting a New Developer Cartridge According to the Further Additional Aspects>

With the laser printer 1 described above, the motor 59 drives the intermediate gear 70 when the developer cartridge 28 is mounted in the main casing 2. While the intermediate gear 70 is driven, the moving member 278 moves and passes the detection position. The information-detecting mechanism 81 detects this passage of the moving member 278. The CPU 100 determines information concerning the developer cartridge 28 (whether the developer cartridge 28 is new and, if new, the maximum number of sheets to be printed with the developer cartridge 28) based on detection results by the information-detecting mechanism 81 (whether a reception signal was inputted and the number of inputted reception signals). Therefore, a laser printer 1 capable of determining information on a developer cartridge 28 can be produced with reduced manufacturing costs through a simple construction provided with a single information-detecting mechanism 81.

After the information-detecting mechanism 81 detects passage of the moving member 278, the interference protrusion 94 interferes with the moving member 278 to prevent the moving member 278 from passing the detection position thereafter. Accordingly, the laser printer 1 according to the further additional aspects can easily and reliably determine whether the developer cartridge 28 is new based on whether the information-detecting mechanism 81 detects passage of the moving member 278 when the developer cartridge 28 is mounted in the main casing 2 and the intermediate gear 70 is driven by the motor 59. Hence, the laser printer 1 can determine the life of the developer cartridge 28 from the point that the developer cartridge 28 was determined to be new.

Since the information-detecting mechanism 81 allows passage of the moving member 278 while detecting this passage, it is possible to provide a plurality of moving members 278 and to have a plurality of moving members 278 pass the detection position. As a result, the CPU 100 can determine information for a plurality of the developer cartridges 28 based on the number of moving members 278 that the information-detecting mechanism 81 detects. Since the information concerning the developer cartridge 28 includes the maximum number of sheets to be printed based on the amount of toner accommodated in the developer cartridge 28, it is possible to accurately determine the life of the developer cartridge 28 mounted in the main casing 2 and to properly replace the developer cartridge 28, even when using developer cartridges 28 having different amounts of toner.

By disposing the moving members 278 on the intermediate gear 70 provided in the developer cartridge 28, it is not necessary to provide a new drive member for transferring the driving force of the motor 59 to the moving member 278. Therefore, it is possible to produce a more compact device, while avoiding a rise in manufacturing costs and structural complexity.

Disposing the moving members 278 on the intermediate gear 70, which can be positioned with more freedom than the input gear 67 and agitator drive gear 71, facilitates placement of the moving members 278 in positions that can easily be detected by the information-detecting mechanism 81.

Further, the contact position between the moving members 278 provided on the intermediate gear 70 and the interference protrusion 94 can be determined by disposing the interference protrusion 94 on the gear cover 66 and covering the intermediate gear 70 with the gear cover 66. This structure ensures that the interference protrusion 94 can reliably interfere with the moving members 278.

Although the moving members 278 contact the contact pawl 86 of the actuator 82, the moving members 278 are able to pass the detection position and subsequently contact the interference protrusion 94, without being hindered by the contact pawl 86. Hence, the information-detecting mechanism 81 can reliably detect passage of the moving members 278.

Further, after the information-detecting mechanism 81 detects passage of the moving members 278, the interference protrusion 94 interferes with the moving members 278 and releases the moving members 278 from movement together with the intermediate gear 70 by maintaining the moving members 278 in a state of interference. In this way, the interference protrusion 94 prevents the information-detecting mechanism 81 from again detecting passage of the moving members 278 thereafter. Hence, a laser printer 1 capable of determining information on the developer cartridge 28 can be produced at a reduced manufacturing cost through a simple construction including the moving members 278, and the interference protrusion 94 that interferes with the moving members 278 so that the moving members 278 no longer move together with the intermediate gear 70.

Further, by coupling the cylindrical part 77 of the intermediate gear 70 with the main intermediate gear body 95 via the frictional member 98, the moving members 278 and the intermediate gear 70 can be coupled through a simple structure using frictional force, thereby enabling the laser printer 1 to determine information on the developer cartridge 28 while reducing manufacturing costs.

Further, if the peripheral length of the moving member 278 is modified to correspond to information on the developer cartridge 28, the CPU 100 can determine information on a plurality of developer cartridges 28 corresponding to various lengths based on the length of time during which the information-detecting mechanism 81 detects the moving member 278.

While the invention has been described in detail with reference to the above aspects thereof, it would be apparent to those skilled in the art that various changes and modifications may be made therein without departing from the spirit of the invention.

<Developer Cartridge According to a Modification of the Further Additional Aspects>

Figure 21:
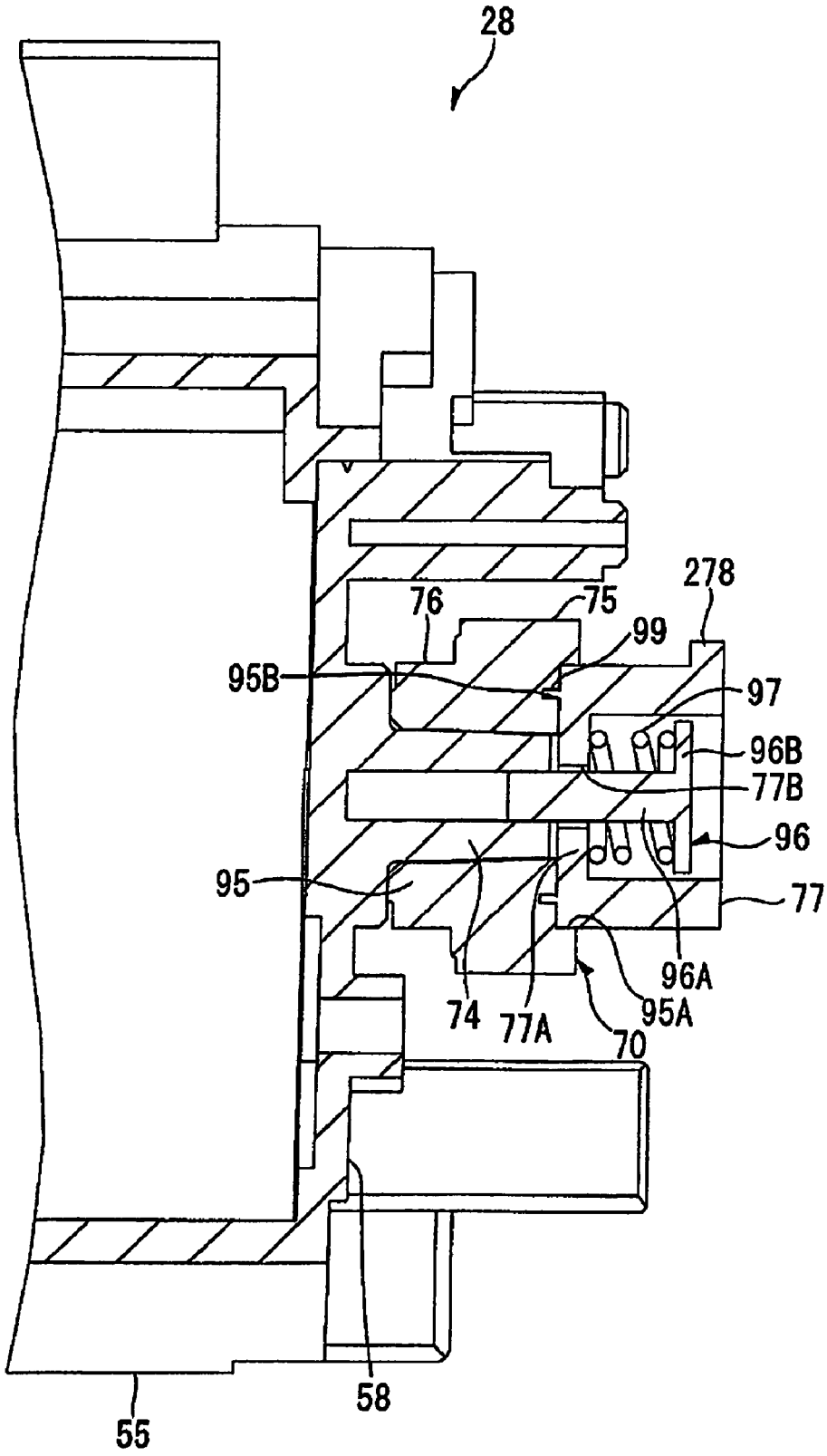
FIG. 21 is a horizontal cross-sectional view of a developer cartridge according to a modification of the further additional aspects, with a gear cover removed.

FIG. 21 is a horizontal cross-sectional view of a developer cartridge according to a modification of the further additional aspects in which the gear cover has been removed, wherein like parts and components are designated with the same reference numerals to avoid duplicating description.

In the modification shown in FIG. 21, the cylindrical part 77 of the intermediate gear 70 is not coupled to the main intermediate gear body 95 by frictional force of the frictional member 98, but rather is coupled to the main intermediate gear body 95 via shear pins 99 protruding from the surface of the end face wall 77A opposing the main intermediate gear body 95 toward the main intermediate gear body 95. Engaging holes 95B are formed in the recessed part 95A of the main intermediate gear body 95 at positions corresponding to the shear pins 99. The cylindrical part 77 is coupled with the main intermediate gear body 95 by fitting the shear pins 99 into the engaging holes 95B.

While the interference protrusion 94 does not interfere with the moving members 278, the cylindrical part 77 of the intermediate gear 70 moves integrally with the main intermediate gear body 95 by the engagement between the shear pins 99 and engaging holes 95B. When the interference protrusion 94 interferes with the moving members 278, the shear pins 99 break, releasing the movement of the intermediate gear 70 in association with the main intermediate gear body 95. Therefore, after the distal end of the leading (front) moving member 278 contacts the interference protrusion 94, as shown in FIG. 20, the moving members 278 are released from moving together with the main intermediate gear body 95. Accordingly, the moving member 278 is maintained in contact with the interference protrusion 94, even as the main intermediate gear body 95 continues to rotate, so that the distal ends of the moving members 278 do not pass by the detection position thereafter. Hence, the interference protrusion 94 prevents the moving members 278 from passing through the detection position a second time. Therefore, after the CPU 100 recognizes the second reception signal, the actuator 82 no longer pivots as the intermediate gear 70 rotates, and the light-receiving element no longer receives the detection light from the optical sensor 83.

Hence, in the modification described above, a laser printer 1 capable of determining information on the developer cartridge 28 can be produced at a reduced manufacturing cost through a simple construction including the moving members 278, and the interference protrusion 94 that interferes with the moving members 278 so that the moving members 278 no longer move together with the intermediate gear 70.

In the aspects described above, the moving members 78, moving member 178, and moving members 278 are provided on the intermediate gear 70. However, these moving members may be provided on another gear, such as the agitator drive gear 71 or developer roller drive gear 69.

In the aspects described above, the developer cartridge 28 is provided separately from the process frame 51, and the photosensitive drum 27 is provided in the process frame 51. However, the developer cartridge may be formed integrally with the process frame 51.

What is claimed is:

1. A developer cartridge configured to be detachably mounted in a main body of an image forming apparatus, the developer cartridge comprising:

a drive member configured to be driven by a driving force and to move in a moving direction when the developer cartridge is mounted in the main body of the image forming apparatus;

a moving portion provided on the drive member and configured to move together with the drive member in the moving direction past a predetermined detection position at least a first time; and an interfering portion disposed downstream of the predetermined detection position with respect to the moving direction, thereby interfering with the moving portion and preventing the moving portion from passing the predetermined detection position a second time.

2. The developer cartridge according to claim 1, wherein the moving portion is configured to be shifted irreversibly from a first position that allows the moving portion to pass the predetermined detection position to a second position that prohibits the moving portion from passing the predetermined detection position; and wherein the interfering portion interferes with the moving portion to shift the moving portion from the first position to the second position.

3. The developer cartridge according to claim 2, wherein the moving portion is supported on the drive member so that the moving portion can pivot from the first position to the second position.

4. The developer cartridge according to claim 3, wherein the moving portion has substantially a rod-shape having: one end pivotally supported on the drive member; and another end configured to pass the predetermined detection position and to be interfered with by the interfering portion.

5. The developer cartridge according to claim 3, wherein the moving portion is shaped substantially like a circular sector having: a central angle side pivotally supported on the drive member; and an arcing peripheral side configured to pass the predetermined detection position and to be interfered with by the interfering portion.

6. The developer cartridge according to claim 1, wherein the moving portion is released from moving together with the drive member when the moving portion is interfered with by the interfering portion; and wherein the moving portion maintains a state of interference with the interfering portion after the moving portion is interfered with by the interfering portion.

7. The developer cartridge according to claim 6, further comprising a coupling member interposed between the moving portion and the drive member so as to move together with the moving portion, the coupling member being configured to move together with the drive member when the moving portion is not interfered with by the interfering portion and to be released from moving together with the drive member when the moving portion is interfered with by the interfering portion.

8. The developer cartridge according to claim 7, wherein the coupling member is formed integrally with the moving portion and is coupled with the drive member by a frictional force that prevents the moving portion from moving relative to the drive member when the moving portion is not interfered with by the interfering portion and that allows the moving portion to move relative to the drive member when the moving portion is interfered with by the interfering portion.

9. The developer cartridge according to claim 7, wherein the moving portion is substantially shaped as a protrusion having: one end fixed to the coupling member; and another end configured to pass the predetermined detection position and to be interfered with by the interfering portion.

10. The developer cartridge according to claim 1, wherein the moving portion comprises a plurality of moving portions.

11. The developer cartridge according to claim 10, wherein a number of the plurality of moving portions corresponds to information on the developer cartridge.

12. The developer cartridge according to claim 11, wherein the information on the developer cartridge includes information indicating whether the developer cartridge is a new product.

13. The developer cartridge according to claim 11, wherein the information on the developer cartridge includes information relating to an amount of developer accommodated in the developer cartridge.

14. The developer cartridge according to claim 1, wherein a width of the moving portion along the moving direction corresponds to information on the developer cartridge.

15. The developer cartridge according to claim 1, wherein the drive member comprises a gear.

16. The developer cartridge according to claim 1, further comprising:

an input gear coupled with a driving-force generating portion of the image forming apparatus when the developer cartridge is mounted in the main body of the image forming apparatus;

an agitator that rotates to agitate developer accommodated in the developer cartridge; and an agitating gear coupled to the agitator, wherein the drive member comprises an intermediate gear that transfers the driving force from the input gear to the agitating gear.

17. The developer cartridge according to claim 1, further comprising a cover member that covers the drive member, wherein the interfering portion is disposed at the cover member.

18. The developer cartridge according to claim 1, further comprising a rotational shaft for rotatably supporting the drive member, wherein a driving-force generating portion of the image forming apparatus is configured to drive the drive member to rotate about the rotational shaft when the developer cartridge is mounted in the main body of the image forming apparatus; and wherein, in a first position, the moving portion is disposed at the drive member to extend along a radial direction of the rotational shaft.

19. An image forming apparatus comprising:

an apparatus main body;

a driving-force generating portion disposed in the apparatus main body and generating a driving force;

a developer cartridge configured to be detachably mounted in the apparatus main body, the developer cartridge comprising:

a drive member configured to be driven by the driving force and to move in a moving direction when the developer cartridge is mounted in the apparatus main body;

a moving portion provided on the drive member and configured to move together with the drive member in the moving direction past a predetermined detection position at least a first time; and an interfering portion disposed downstream of the predetermined detection position with respect to the moving direction, thereby interfering with the moving portion and preventing the moving portion from passing the predetermined detection position a second time;

a detecting portion that detects passage of the moving portion at the predetermined detection position; and an information determining portion that determines information on the developer cartridge based on detection results of the detecting portion.

20. The image forming apparatus according to claim 19, wherein the moving portion is configured to be shifted irreversibly from a first position that allows the moving portion to pass the predetermined detection position to a second position that prohibits the moving portion from passing the predetermined detection position; and wherein the interfering portion interferes with the moving portion to shift the moving portion from the first position to the second position.

21. The image forming apparatus according to claim 20, wherein the moving portion is supported on the drive member so that the moving portion can pivot from the first position to the second position.

22. The image forming apparatus according to claim 21, wherein the moving portion has substantially a rod-shape having: one end pivotally supported on the drive member; and another end configured to pass the predetermined detection position and to be interfered with by the interfering portion.

23. The image forming apparatus according to claim 21, wherein the moving portion is shaped substantially like a circular sector having: a central angle side pivotally supported on the drive member; and an arcing peripheral side configured to pass the predetermined detection position and to be interfered with by the interfering portion.

24. The image forming apparatus according to claim 19, wherein the moving portion is released from moving together with the drive member when the moving portion is interfered with by the interfering portion; and wherein the moving portion maintains a state of interference with the interfering portion after the moving portion is interfered with by the interfering portion.

25. The image forming apparatus according to claim 24, further comprising a coupling member interposed between the moving portion and the drive member so as to move together with the moving portion, the coupling member being configured to move together with the drive member when the moving portion is not interfered with by the interfering portion and to be released from moving together with the drive member when the moving portion is interfered with by the interfering portion.

26. The image forming apparatus according to claim 25, wherein the coupling member is formed integrally with the moving portion and is coupled with the drive member by a frictional force that prevents the moving portion from moving relative to the drive member when the moving portion is not interfered with by the interfering portion and that allows the moving portion to move relative to the drive member when the moving portion is interfered with by the interfering portion.

27. The image forming apparatus according to claim 25, wherein the moving portion is substantially shaped as a protrusion having: one end fixed to the coupling member; and another end configured to pass the predetermined detection position and to be interfered with by the interfering portion.

28. The image forming apparatus according to claim 19, wherein the moving portion comprises a plurality of moving portions.

29. The image forming apparatus according to claim 28, wherein a number of the plurality of moving portions corresponds to information on the developer cartridge; and wherein the information determining portion determines information on the developer cartridge based on the number of the plurality of moving portions detected by the detecting portion.

30. The image forming apparatus according to claim 19, wherein a width of the moving portion along the moving direction corresponds to information on the developer cartridge; and wherein the information determining portion determines information on the developer cartridge based on a detection period during which the detecting portion detects the moving portion.

31. The image forming apparatus according to claim 19, wherein the information on the developer cartridge includes information indicating whether the developer cartridge is a new product.

32. The image forming apparatus according to claim 19, wherein the information on the developer cartridge includes information relating to an amount of developer accommodated in the developer cartridge.

33. The image forming apparatus according to claim 19, wherein the drive member comprises a gear.

34. The image forming apparatus according to claim 19, wherein the developer cartridge further comprises:

an input gear coupled with the driving-force generating portion when the developer cartridge is mounted in the apparatus main body;

an agitator that rotates to agitate developer accommodated in the developer cartridge; and an agitating gear coupled to the agitator, wherein the drive member comprises an intermediate gear that transfers the driving force from the input gear to the agitating gear.

35. The image forming apparatus according to claim 19, wherein the developer cartridge comprises a cover member that covers the drive member; and wherein the interfering portion is disposed at the cover member.

36. The image forming apparatus according to claim 19, wherein the developer cartridge comprises a rotational shaft for rotatably supporting the drive member;

wherein the driving-force generating portion is configured to drive the drive member to rotate about the rotational shaft when the developer cartridge is mounted in the apparatus main body; and wherein, in the first position, the moving portion is disposed at the drive member to extend along a radial direction of the rotational shaft.

37. The image forming apparatus according to claim 19, wherein the detecting portion comprises a contact part that contacts the moving portion when the moving portion passes the predetermined detection position; and wherein the moving portion is configured to pass the predetermined detection position without being hindered by the contact part when contacted by the contact part.

* * * * *